US012534858B2

(12) United States Patent
Green

(10) Patent No.: US 12,534,858 B2
(45) Date of Patent: Jan. 27, 2026

(54) COMPOSITE BOARD SYSTEM WITH ARTIFICIAL TURF AND DRAINAGE FEATURES

(71) Applicant: Green Eagle USA, LLC, Georgetown, SC (US)

(72) Inventor: Guerry E Green, Georgetown, SC (US)

(73) Assignee: Green Eagle USA, LLC, Georgetown, SC (US)

( * ) Notice: Subject to any disclaimer, the term of this patent is extended or adjusted under 35 U.S.C. 154(b) by 0 days.

(21) Appl. No.: 19/299,434

(22) Filed: Aug. 14, 2025

(65) Prior Publication Data

US 2025/0369196 A1 Dec. 4, 2025

Related U.S. Application Data

(63) Continuation-in-part of application No. 18/216,739, filed on Jun. 30, 2023.

(51) Int. Cl.
*E01C 13/08* (2006.01)

(52) U.S. Cl.
CPC ..... *E01C 13/083* (2013.01); *E01C 2201/20* (2013.01)

(58) Field of Classification Search
CPC ..... E01C 13/083; E01C 2201/20; E01C 2013/08; E04F 15/02183; E04B 1/003
See application file for complete search history.

(56) References Cited

U.S. PATENT DOCUMENTS

| | | | | |
|---|---|---|---|---|
| 11,807,417 | B1 * | 11/2023 | Green | B65D 19/0095 |
| 2003/0082359 | A1 * | 5/2003 | Scott | E01C 13/02 428/221 |
| 2004/0028478 | A1 * | 2/2004 | Lekhtman | B63B 35/34 405/218 |
| 2004/0177578 | A1 * | 9/2004 | Casimaty | A01G 9/033 52/653.1 |
| 2009/0186716 | A1 * | 7/2009 | Lancia | A63B 67/02 473/157 |
| 2023/0304229 | A1 * | 9/2023 | Tabibnia | E04F 15/02183 |

* cited by examiner

*Primary Examiner* — Kyle Armstrong
(74) *Attorney, Agent, or Firm* — Bryan L. Baysinger; Maynard Nexsen PC

(57) ABSTRACT

A deck board system for integrating artificial turf and drainage features includes a plurality of deck board panels, each with an extruded or pultruded panel body featuring an internal screw boss, an internal reinforcement strip, an overhang, a ledge, drainage openings on the topside, and underside openings. The system further comprises a finishing feature and an artificial turf layer. The overhang engages with adjacent panels, while the finishing feature straddles at least two panels and engages with the overhang. The artificial turf layer covers one or more deck board panels, providing a seamless and functional deck surface with integrated drainage capabilities.

18 Claims, 17 Drawing Sheets

COMPOSITE BOARD SYSTEM WITH ARTIFICIAL TURF AND DRAINAGE FEATURES

CROSS-REFERENCE

This application is a continuation-in-part of and claims the benefit and priority of U.S. patent application Ser. No. 18/216,739, filed on Jun. 30, 2023, entitled Deck Board Assembly and Components Thereof, and Methods of Manufacturing and Using the Same.

FIELD

This disclosure relates to support surface structures and components thereof, particularly, composite board assemblies for playing fields, gymnasiums, deck structures, and outdoor structures, for quick and efficient system, environmental resistance, shock absorbent properties, and appealing aesthetics.

BACKGROUND

A board system or surface deck refers to a horizontal platform or support surface that is above the underlying layer, such as a fill layer, gravel layer, ground or other surface type material. Surface decks are commonly found to support various stadium structures, including fields, and gymnasiums, as well as a host of outdoor structures. Support surfaces, especially those for human activity and sport, usually are susceptible to use forces from above (e.g., acute downward forces, and/or widespread downward forces), and susceptible to environmental erosive forces. Moreover, artificial or temporary support surfaces, typically lack drainage. These rapid install deck solutions are often lacking in durability, provide uncertain movement (resistive forces), fail to drain adequately (pool water), and are often heavy and cumbersome to install.

Decks for playing fields serve multiple purposes, including: (1) providing structural support (e.g., decks contribute to the overall strength and stability, and distribute the weight and loads from various components); (2) safety and accessibility (e.g., decks prevent underlying soil or ground contaminants such as rocks or other debris from injuring athletes); (3) functional areas (e.g., different areas of the decks may be designated for specific functions, such for increased rebound to protect athletes in contact sports, or for more rigidity to handle large weights such as in weight lifting), and (4) draining and environmental solutions.

Traditional decks are commonly assembled using wooden materials such as teak, mahogany, or water-resistant, waterproof, or marine-grade plywood. This method involves securing wooden planks or boards to a structural framework using stainless steel screws, nails, or specialized fasteners designed for marine applications. The planks are typically treated with sealants or varnishes to enhance durability and protect against moisture. However, traditional wood construction is often labor-intensive, requiring precise measurements, cutting, and fitting of each plank. Additionally, wood is susceptible to rot, decay, and warping over time, especially when exposed to moisture and harsh marine environments. Regular maintenance, including sanding, resealing, and refinishing, is necessary to preserve the structural integrity and appearance of the wood.

Fiberglass Reinforced Plastic (FRP) panels are a popular alternative to traditional wood construction. These panels consist of layers of fiberglass and polyester or epoxy resin, providing strength, durability, and resistance to corrosion. To assemble decks with FRP panels, the panels are typically cut to size and then attached to a framework, or placed/assembled above a prepared or leveled substrate, using either adhesive bonding, mechanical fasteners, or a combination of both. Adhesives such as epoxy or polyurethane-based formulations are commonly used for bonding FRP panels to the framework. Mechanical fasteners, such as stainless steel screws or bolts, may be employed as additional reinforcement. Proper surface preparation, including cleaning and sanding, is crucial for ensuring a strong bond between the panels and the framework. Despite the improved strength and longevity offered by FRP panels, improper installation, inadequate bonding, or insufficient maintenance can lead to delamination and reduced structural integrity over time.

Decking systems have gained popularity in recent years due to their ease of installation and versatility. These systems consist of pre-made deck boards, slats, tiles, or panels that interlock to create a seamless surface. The tiles or panels are typically made from composite materials (e.g., wood-plastic composites), PVC, or aluminum. Composite materials offer enhanced durability, resistance to moisture, UV rays, and fading, which makes them suitable for marine environments. These solutions are often made for residential use, and are subject to fatigue and stress fractures from any large bearing capacity.

Further, the installation of decking systems usually involves laying a grid-like framework or support structure over a frame or over a finished or leveled substrate. The pre-made boards, slats, tiles, or panels are then placed and interlocked on top of the framework or substrate. Some decking systems employ specialized clips or connectors to ensure secure attachment. Often times, these systems demand professional expertise and an understanding of the methods and/or specialized tools needed for installing the system.

Often times the solutions require virgin materials, or materials that do not include regrind or other foreign materials. Namely, the addition of certain materials may weaken the integrity or may provide warping or other unwanted side effects.

Thus, there is a long sought need for a pre-made solution that may comprise recycled materials, weight bear large capacities, drain water, maintain resistance to the environmental damage, and be infinitely recyclable. The disclosure herein, and the various embodiments, provide for a deck board with artificial turf that can meet the challenges of fatigue, longevity, recyclability, providing reliable drainage, and that are resistant to environmental and use damage.

SUMMARY

According to its major aspects and briefly recited, the techniques described herein relate to a deck board system with artificial turf and drainage features, including: (i) a first deck board panel and a second deck board panel, the first and second deck board panel each including an extruded or pultruded panel body including an internal screw boss and an internal reinforcement strip, the first and second deck panel each having a side including an overhang, an opposite side including a ledge, wherein the overhang is configured to engage with an ledge of an adjacent deck board panel; (ii) a topside and an underside drainage openings on the first and second deck board panels; (ii) a finishing feature applied to a side of at least the first or second deck board panel; and (iii)

an artificial turf layer, wherein the artificial turf layer is configured to cover the first and second deck boards panels of the deck board.

In some aspects, the techniques described herein relate to a deck board system, wherein the first and second deck board panels are modular.

In some aspects, the techniques described herein relate to a deck board system, wherein the extruded or pultruded panel body further includes two or more of the internal reinforcement strips.

In some aspects, the techniques described herein relate to a deck board system, wherein the extruded or pultruded panel body further includes a chemically bonded use surface, and wherein the chemically bonded use surface secures the artificial turf layer.

In some aspects, the techniques described herein relate to a deck board system, wherein the finishing feature is a rounded edge panel.

In some aspects, the techniques described herein relate to a deck board system, wherein the rounded edge panel is configured to meet with the chemically bonded use surface of the first deck board panel and the second deck board panel.

In some aspects, the techniques described herein relate to a deck board system, wherein the deck board system further includes a plug for an aperture through the finishing feature.

In some aspects, the techniques described herein relate to a deck board system, wherein the extruded or pultruded panel body includes a closed cell foam filling, and wherein the closed cell foam filling defines corresponding drainage channels.

In some aspects, the techniques described herein relate to a deck board system, wherein the extruded or pultruded panel body includes an open cell foam filling.

In some aspects, the techniques described herein relate to a method of producing a deck board with artificial turf and drainage features, including: (iii) providing a first deck board panel and a second deck board panel, the first and second deck board panel each including an extruded or pultruded panel body including an internal screw boss and an internal reinforcement strip, the first and second deck panel each having a side including an overhang, an opposite side including a ledge, wherein the overhang is configured to engage with an ledge of an adjacent deck board panel; (iv) preparing a topside and an underside with drainage openings on the first and second deck board panels; (ii) applying a finishing feature, wherein the finishing feature is applied to a side of at least the first or second deck board panel; and (iii) applying an artificial turf layer, wherein the artificial turf layer is applied to cover the first and second deck boards panels of the deck board.

In some aspects, the techniques described herein relate to a deck board method, wherein the first and second deck board panels are modular.

In some aspects, the techniques described herein relate to a deck board method, wherein the extruded or pultruded panel body further includes two or more of the internal reinforcement strips.

In some aspects, the techniques described herein relate to a deck board method, wherein the extruded or pultruded panel body further includes a chemically bonded use surface, and wherein the chemically bonded use surface secures the artificial turf layer.

In some aspects, the techniques described herein relate to a deck board method, wherein the finishing feature is a rounded edge panel.

In some aspects, the techniques described herein relate to a deck board method, wherein the rounded edge panel is configured to meet with the chemically bonded use surface of the first deck board panel and the second deck board panel.

In some aspects, the techniques described herein relate to a deck board method, wherein the deck board system further includes a plug for an aperture through the finishing feature.

In some aspects, the techniques described herein relate to a deck board method, wherein the extruded or pultruded panel body includes a closed cell foam filling, and wherein the closed cell foam filling defines corresponding drainage channels.

In some aspects, the techniques described herein relate to a deck board method, wherein the extruded or pultruded panel body includes an open cell foam filling.

These and other advantages will be apparent to those skilled in the art based on the following disclosure.

BRIEF DESCRIPTION OF THE DRAWINGS

Many aspects of the present disclosure will be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views. It should be recognized that these implementations and embodiments are merely illustrative of the principles of the present disclosure. Therefore, in the drawings.

DETAILED DESCRIPTION

Figure 1:
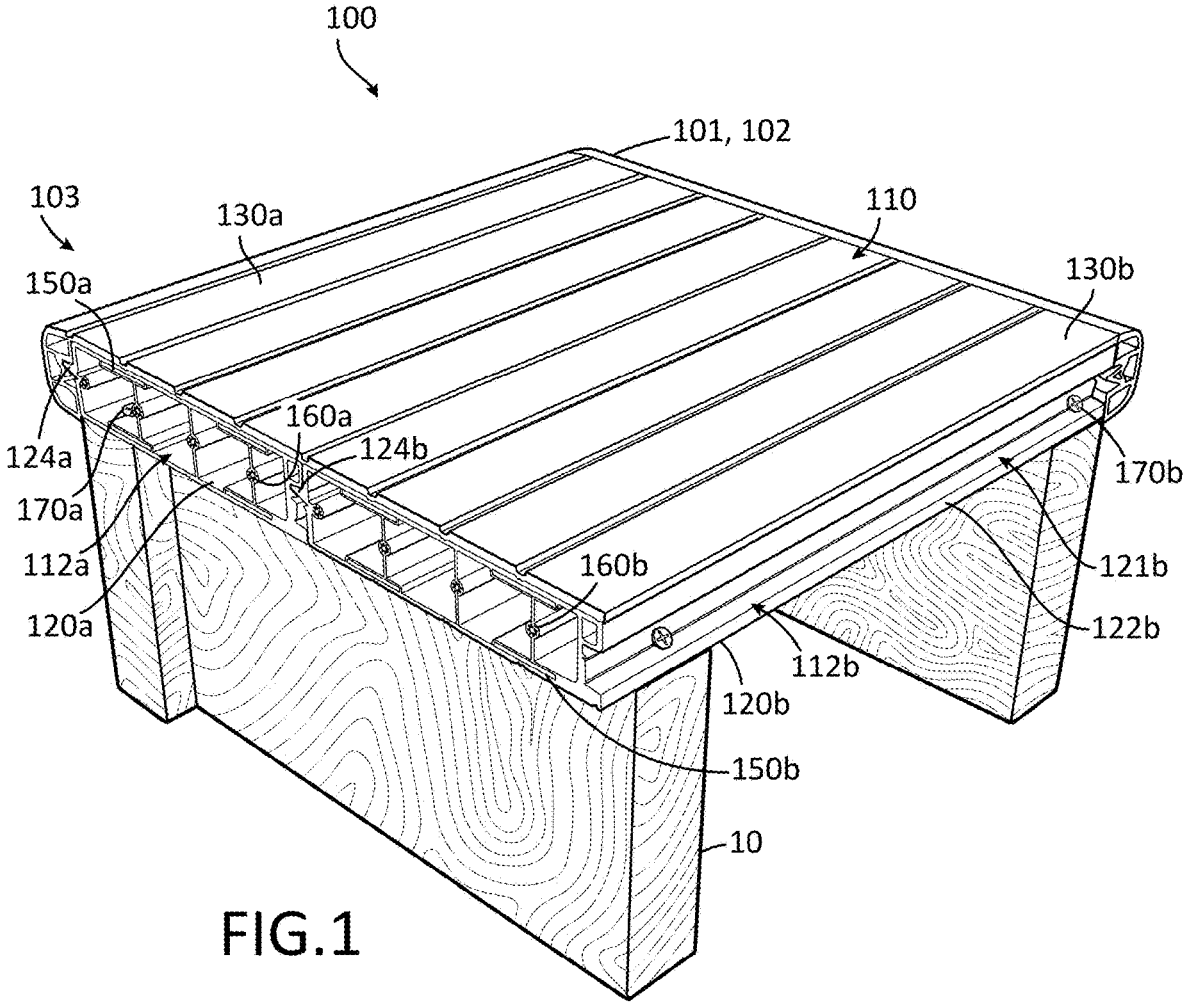
FIG. 1 is a perspective view of an illustration of an example deck board system according to the present disclosure.

The presently disclosed subject matter now will be described more fully hereinafter with reference to the accompanying drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

I. Example Use Case Scenarios

Decks fabricated with conventional wood construction are susceptible to rot, decay, and warping over time, especially when exposed to moisture and/or harsh marine environments. Proper maintenance, including regular inspections, sealing, and refinishing, is necessary to mitigate these issues. Similarly, improper installation or inadequate maintenance of FRP panels can result in delamination, which reduces the overall structural strength and integrity of the deck components. Regular inspections, repairs, and adherence to manufacturer guidelines are essential to maintain the structural integrity of FRP assemblies.

In either case, traditional wood construction and FRP panels add significant weight to land-based decks or boats. Consequently, decking systems have gained popularity in recent years due to their ease of installation, relative low cost, and versatility. Decking systems are available in a range of materials, including wood-plastic composites, PVC, and aluminum. Wood-plastic composites offer the aesthetic appeal of wood while providing enhanced durability, moisture resistance, and resistance to solar radiation and fading. PVC and aluminum panels may also be used and incorporated into the systems as these components are known for their lightweight properties, corrosion resistance, and low maintenance requirements.

The installation of decking systems typically involves laying a grid-like framework or support structure, or finishing and/or leveling a substrate. This framework or substrate provides stability and ensures proper load distribution. The pre-made boards, slats, tiles, or panels of the decking system are then placed and interlocked on top of the framework or substrate.

While conventional decking systems offer the above stated benefits, they have limitations when it comes to drainage and aesthetics. For example, traditional deck systems usually offer few if any drainage features. Moreover, if drainage features are offered, they are rarely effective at properly draining liquids away from the majority of the deck and/or away from the majority of the support surface. Traditional deck systems also usually offer few support-surface customization options; instead, traditional deck systems typically offer flat, planar wooden or wood-like surfaces (e.g., teak or parquet). As such, in at least one aspect, the disclosure herein is directed to improved support surface structures, in particular, to modular deck board assemblies and decking system components having drainage features and support-surface customization options such as artificial turf features, and to improved methods of producing and assembling the same. In the same vein, the lessons and techniques disclosed herein are applicable to any support structure or surface.

II. Systems and Methods

In one aspect, the support surface structure or deck board according to the present disclosure is a multi-component system that allows for easy system, use, and/or dissystem of the structure for use in gymnasiums, stadiums, outdoor fields, or even on docks or other structures that may require features such as rapid installation, drainage, artificial turf grass aesthetic, and cushioning relative to the subsurface. The support surface structure or deck board, in one aspect, includes a plurality of molded, extruded, or pultruded components, although other manufacturing methods are envisioned. These components can be easily transported (stacked or nested, for example) and installed/assembled on site. In another aspect, the support surface structure includes a modular deck board system of the panel variety, although other modular and non-modular types are envisioned. In particular, in another aspect, the deck board system yields a sturdy and rigid deck board that appears, aesthetically, as if made from a plurality of single-piece lineal boards or lineal slats, instead of deck board panels. This single-piece allows for a uniform appearance when applying an artificial turf layer, and avoids any ridges or protrusions that may change, for example, a playing field for athletic sport.

In another aspect, the deck board with artificial turf produced from the installed deck board system appears to be made from conventionally installed wooden or teak deck boards or slats, without the negative qualities innate to conventional decking solutions. In another aspect, the deck board with artificial turf produced from the installed deck board system comprises drainage features, on the support surface or deck board floor, and/or on an underside surface of the deck board, to allow for proper drainage into sublayers. In another aspect, the deck board with artificial turf produced from the installed deck board system includes support-surface customization options such ranging from artificial turf to live turf installation. In another aspect, the deck board with artificial turf produced from the installed deck board system includes internal filling to dampen or mitigate vibrations and/or resonance from use of the support surface.

In one aspect, the deck board system according to the present disclosure is part of a decking system including a frame that is assembled and built for an athletic floor such as for a gymnasium or indoor/outdoor stadiums. The frame is configured to hold one or more support surfaces or deck board floors/levels. Each deck board floor or level, in one aspect, is made of a deck board system having a plurality of side-by-side deck board panels. The deck board panels, in another aspect, are configured to interconnect to create a contiguous, seemingly-flush support surface. Moreover, the deck board system or the deck board components may be manufactured to include internal structures (embedded or removable/replaceable) that are the same or a different material than the deck board system or the deck board components. In another aspect, the internal structures may be formed using a different manufacturing method than the deck board system or the deck board components. In another aspect, the internal structures may be configured to function as drainage channels or passageways for downward running or falling liquids (such as rain or runoff) draining in from above the deck board panel(s), and/or as water spreading spaces or cavities. Furthermore, the deck board system components or panels, in another aspect, may be further processed (e.g., cut, sheared, sawed, etched, chamfered, notched, bent, drilled, bored, built-up, chemically prepared, machined, etc.) as need.

In one aspect, each deck board panel of a deck board system according to the present disclosure is configured to be held and supported directly by a different portion of a frame, or by a finished or leveled substrate. The deck board panel(s) of the deck board system, in one aspect, include a use surface, and a panel body configured to touch and/or interlock with an adjacent deck board panel body of the deck board system. In another aspect, each panel body may have no distinct use surface; instead, the deck board system offers an artificial turf layer, for example, that extends over multiple assembled panel bodies. Moreover, the panel body of each deck board panel, in one aspect, includes internal structures that provide structural integrity to the panel body such that the deck board panel can withstand loads placed on it during use. In another aspect, the panel body of the deck board panels may include an embedded internal reinforcement strip or strips. In another aspect, the panel body defines apertures, openings, or traversing channels that function as drainage features or that function simply for channeling liquids to or through different regions or portions of a deck board panel. In another aspect, the use surface if present may define apertures, openings, or traversing channels that correspond to the apertures, openings, or traversing channels of the panel body. In this way, the apertures, openings, or traversing channels of the panel body (and use surface) are configured to function as drainage features for channeling liquids from the artificial turf layer, for example, to or through different regions or portions of the deck board panel.

In one aspect, the use surface of each deck board panel according to the present disclosure is a flexible PVC that is mechanically engaged to and/or chemically bonded to the panel body of each deck board panel. In particular, in another aspect, the use surface may be enhanced or altered by scuffing, scarring, and other processes that add texture and surface area adhesion. The use surface, in another aspect, may be further processed or finished (e.g., cut, sheared, sawed, etched, chamfered, notched, bent, drilled, bored, built-up, sanded, worn, chemically prepared, machined, etc.) as needed. In one aspect, the use surface may be computer numerically controlled (CNC) drilled to form aperture, openings, or traversing channels therethrough. In this way, for example, the use surface may appear, aesthetically, as if made from a plurality of single-piece lineal boards or lineal slats, although other aesthetic surface finishes are envisioned including surface finishes that look like stone, concrete, marble, monolithic wood, parquet, tile, resin, etc. In another aspect, the use surface may have spaced openings—of either uniform or varied sizes and/or shapes—therethrough. In another aspect, the use surface may be modified to better receive and hold an artificial turf layer, for example.

In one aspect, the use surface may be configured as a flat or generally planar surface. As such, the use surface is supported and held directly by the panel body of the deck board panel, and as such the use surface is configured to provide a stable support surface for an assembled deck board.

In one aspect, the panel body of each deck board panel according to the present disclosure serves to receive and hold the use surface for each deck board panel (and/or serves to receive and hold an artificial turf layer, for example), and serves to receive and hold the only mechanical fasteners demanded by the deck board system (for securably attaching the deck board panels to a frame). In another aspect, the deck board system may call for mechanical fasteners (friction-fit, snap-fit, screws, etc.) for securing the use surface to the panel body and/or for securing any other component of the system (e.g., any other lineal members or finishing features as described herein). In another aspect, the panel body defines a surface feature or recess for receiving and holding the use surface, or for receiving the material for the use surface, or for receiving and holding the artificial turf layer.

In particular, in one aspect, the panel body includes a screw boss(es) to receive the system screws. In one aspect, the screw boss(es) help to securably attach (via mechanical fasteners, for example) other components of the deck board system to the panel body and/or the use surface. Importantly, system screws may be driven into the screw boss(es) that are exposed at the ends of the panel body. In another aspect, the system screws also may be driven (e.g., from the side(s) or from within at any point along the length of the panel body, for example, into the internal screw boss (the entire screw boss extending along a length of the panel body, for example).

In one aspect, the deck board panel body is a lineal member produced from an extrusion or pultrusion manufacturing process. Other components of the deck board system may be produced from an extrusion or pultrusion manufacturing process as well. The components for the deck board system in the form of lineal members, in on aspect, may be made at least in part of polymeric materials or equivalent, e.g., low-density polyethylene (LDPE) (a chemically inert, flexible, insulator), high-density polyethylene (HDPE) (inert, thermally stable, tough and high tensile strength); polypropylene (resistant to acids and alkalis, high tensile strength); polyvinyl chloride (PVC) (insulator, flame retardant, chemically inert); polychlorotrifluoroethylene (PCTFE) (stable to heat and thermal, high tensile strength and non-wetting); polyamide (Nylon) (high melting point, excellent abrasion resistance); polyethylene terephthalate (PET) & (PETG) (High strength and stiffness, broad range of use temperatures, low gas permeability), etc. In another aspect, the components for the deck board system also may be made of recycled materials or may incorporate embedded internal reinforcement strip such as embedded reinforcement fibers (glass fibers, carbon fibers, bast fibers) as is understood in the art or reinforcement strips as described herein. The components for the deck board system, in another aspect, may be formed of "color-blend" recycled plastics or polymers as is known in the art. The components for the deck board system, in another aspect, may be formed of scrap carbon fiber, and fiber glass and glass fibers, as well as any other polymers and/or any other natural (e.g., plant-based or plant derived) or non-natural fiber(s).

In one aspect, the deck board system and/or the deck board component(s) incorporate or is made of a non-homogeneous composition of matter having both compressive strength and stiffness which enables it to be used as a substitute for wood in a wide variety of applications. In another aspect, the structural composite for the deck board component(s) according to the present disclosure can be substituted with other materials having a higher strength modulus than wood, such as aluminum.

In particular, in one aspect, the deck board system and/or the deck board panel component(s) are engineered, meaning that its exterior shape and the choice of its external or internal features or components (e.g., screw boss(es)) and their locations and shapes are based at least in part on the demands as specified herein. The deck board system and/or the deck board panel component(s) may be extruded or pultruded lineal composite structures produced with embedded reinforcement strip(s) that are spaced away from the neutral axis, analogous to the flanges on and I-beam, or asymmetrically situated, in order to provide increased strength and stiffness in one or both axes perpendicular to the cross-section.

In one aspect, the deck board system and/or the deck board panel component(s) incorporate or is made of a structural polymeric composite, which include a polymer and stiffening additivities, typically waste glass fiber, carbon fiber, or bast fibers. In one aspect, the deck board system and deck board component(s) incorporate polyvinyl chloride (PVC) and/or recycled PVC. In one aspect, the deck board system and deck board panel component(s) incorporate polyamides. In one aspect, the deck board system and deck board panel component(s) incorporate a shredded fibrous material, for example, shredded carbon fiber. In one aspect, the deck board system and deck board component(s) incorporate a shredded fibrous material, for example, shredded fiberglass in waste, virgin, or blended form (waste+virgin). In one aspect, the deck board system and deck board component(s) incorporate a shredded fibrous material, for example, shredded bast fibre. In one aspect, the deck board system incorporates a first polymeric layer of PVC and/or recycled PVC, in which an additive is applied.

Referring to methods herein, in one aspect, a method of assembling a deck board with a deck board system comprising a plurality of deck board panels is disclosed. In one aspect, the method comprises providing a lineal panel body having a use surface adhered or laminated thereon and CNC drilling through the use surface and the underlying lineal panel body, and providing mechanical fasteners for installing the deck board panels to a deck frame. The method also comprises, in one aspect, providing, unrolling, laying, and installing an artificial turf layer (or system), for example, on top of a plurality of assembled deck board panels. The method also comprises, in one aspect, securably fastening each of the plurality of deck board panels onto the frame, starting with a first deck board panel and then proceeding to place and slide a second deck board panel into position, adjacent, to the first deck board panel, and so on and so forth for the remainder of the plurality of deck board panels. In another aspect, the method also comprises interconnecting and/or interlocking each subsequent deck board panel with a previously installed deck board panel to prevent the subsequent deck board panel from shifting and/or moving relative to the previously installed deck board panel. In another aspect, the method comprises CNC drilling the lineal panel body separately from the use surface. In another aspect, the method comprises CNC drilling the lineal panel body between the reinforcement strips or in places where a reinforcement is not located or embedded.

In one aspect, the component elements allow for circularity in system, and repair of broken components. Namely, the infinitely recyclable components may be repaired when broken by shredding, reheating, extruding or molding, and replacing the broken part. Thus, aspects of this disclosure allow cradle to cradle use, lowering the costs of making deck boards from virgin materials, and reducing emissions and greenhouse gases associated with creating more virgin material.

In one aspect, a method of using the deck board with artificial turf for gymnasiums and stadiums is disclosed. In another aspect, the deck board components are stacked or nested and transported in a box. The stacked and/or nested deck board components conserve space and allow for ready and fast system on site.

III. With Reference to the Figures

The term "extruded" is used herein for convenience but deck board may be formed in any way customary in the industry, for example, pultruded and co-extruded with other materials. Resin fusion and vacuum fusion methods are also envisioned.

The term "lineal" is used herein to refer to an extruded deck board component having a uniform cross section perpendicular to its major dimension which major dimension is much longer than its other two dimensions; that is, the plane of any cross section perpendicular to the major dimension of the deck board component is defined by a line parallel to the major dimension.

The term "non-homogeneous" as used herein means that at least some of the constituents are concentrated within the structural composite rather than being homogeneously dispersed.

The term "screw boss" is a physical structure that grips the threads of a screw being driven into it so that, once the screw has been inserted into or through the screw boss, the screw boss resists the removal of the screw more when the screw is pulled than when the screw is unscrewed.

A "mechanical fastener" is a mechanism or structure that helps to fasten to items or two components together, and may include but is not limited to screws, nails, bolts, pegs, mating structures, snap or button mechanisms, etc.

Accordingly, a user, a business, and/or a contractor can affectively manufacture, stack/nest, assemble, use, disassemble, store, and/or recycle the deck board system and the deck board panel components based on the systems and methods of the present disclosure. The deck board panel components and the resulting deck board assemblies according to the present disclosure are easier to produce, assemble, and customize than conventional decking systems. The deck board panel components and the resulting deck board assemblies according to the present disclosure allow for ready and efficient transport of deck board panel and system components on site, as needed, and rapid system and use of those components and resulting playing surfaces.

Referring now to FIG. 1, a perspective view of an illustration of an example deck board system according to the present disclosure is shown. In particular, in FIG. 1 there is shown a multi-component, modular type deck board system 100 including a plurality of modular deck board panels 110 and a plurality of finishing features 101, in particular, a plurality of rounded edge panels 102. The deck board system 100 is assembled and installed on a frame 10 to create a contiguous, seemingly-flush, generally planar support surface 103 that is both sturdy and rigid.

As illustrated in FIG. 1, each of the plurality of modular deck board panels 110 of the deck board system 100, in particular, the deck board panel 112*a* and the deck board panel 112*b*, has an extruded panel body 120*a*, 120*b*, respectively, and a use surface 130*a*, 130*b* respectively. More specifically, as illustrated in FIG. 1, the plurality of modular deck board panels 110 are made of recycled PVC and fiber and are manufactured to include one or more internal reinforcements 150 and one or more screw bosses 160. The one or more internal reinforcements 150*a*, 150*b* provide structural integrity to the panel body 120*a*, 120*b* such that each deck board panel 112*a*, 112*b*, respectively, can withstand downward loads (i.e., loads towards the frame) placed thereon. The one or more internal reinforcements may be comprised of several layers for increasing rigidity. For example, the internal reinforcements may comprise a first polymeric layer with a layer height ranging from 0.20 mm to 1.20 mm; a first mesh layer comprised of a fiberglass or other rigid polymer or metal, a composite layer of shredded fibrous material (carbon fiber, bast fibers, glass fibers) and polymeric material, such as PET. In this aspect, the shredded fibrous material may be of an average length between 5.0 mm and 50 mm, and the polymeric material may have a granular size from 50 microns to 2000 microns prior to heating and extruding; a second mesh layer of fiberglass or other polymer or metal, and a second polymeric layer to fully encapsulate and form a sandwich of layers.

The one or more screw bosses 160 are configured to receive mechanical fasteners 170 for installing each deck board panel 112 of the deck board system 100 to the frame 10. The one or more screw bosses 160 also are configured to receive the mechanical fasteners 170 for installing other components of the deck board system 100 to the deck board panels 112*a*, 112*b* (best seen in FIGS. 9 and 10).

Depending on the embodiment, additional deck board panels 112 and/or finishing features 101 may be part of the deck board system 100 a (i.e., three or more, four or more, etc. deck board panels 112 and a complementary number of rounded edge panels 102). Moreover, the deck board panels 112 and/or the finishing features 101 may be further processed (e.g., cut, sheared, sawed, etched, chamfered, bent, pre-drilled, bored, built-up, chemically prepared, machined, etc.) during manufacturing or on-site during system. In some aspects, the deck board panels 112 and/or the finishing features 101 are pre-drilled or pre-bored to allow for ready placement and use of the mechanical fasteners 170 (best in FIG. 8). Furthermore, each of the deck board panels 112 and/or the finishing features 101 may further incorporate embedded reinforcement fibers, strands, or rebar-like lineal structures according to the present disclosure.

Returning to FIG. 1, the extruded panel body 120 of each of the plurality of modular deck board panels 110 according to the present disclosure serves to receive and hold the use surface 130. In particular, as illustrated in FIG. 1, the use surface 130 is chemically bonded to the panel body 120 of each of the plurality of modular deck board panel 110. Moreover, the use surface 130 may be made of flexible PVC and further processed or finished (e.g., scuffed, cut, sheared, sawed, etched, chamfered, notched, bent, drilled, bored, built-up, sanded, worn, chemically prepared, machined, etc.) to appear, aesthetically, as if made from a plurality of single-piece lineal boards or lineal slats. In particular, as illustrated in FIG. 1, the use surface 130 of each of the plurality of modular panels 110 appears to be made from conventionally installed wooden or teak deck boards or slats.

As further illustrated in FIG. 1, the extruded panel body 120 of each of the plurality of modular deck board panels 110 according to the present disclosure serves to receive and hold the mechanical fasteners 170. In particular, as illustrated in FIG. 1, the extruded panel body has edge features 121, in particular, ledge(s) 122 (best seen in FIGS. 5 and 6) through which the mechanical fasteners are screwed and into the frame 10 beneath. Depending on the embodiment, the mechanical fasteners 170 may be screwed through the ledge 122 adjacent to the internal reinforcement 150 and not through the internal reinforcement 150. Furthermore, as illustrated in FIG. 1, the extruded panel body 120 also has an overhang 124 (i.e., an edge feature 121) configured to touch and/or interlock with an adjacent deck board panel 112 of the deck board system 100 (best seen in FIGS. 7 and 8). Depending on the embodiment, the extruded panel body 120 of each of the plurality of modular deck board panels 110 may be pre-drilled or pre-bored to allow for easy configuration with mechanical fasteners. Furthermore, the extruded panel body 120 may incorporate embedded reinforcement fibers, strands, or rebar-like lineal structures according to the present disclosure. Depending on the embodiment, the extruded panel body 120 may be formed entirely of rolled metal instead of being an extrusion or pultrusion product. Regardless of the composition the various components may be prepared with pre-drilling, or treated with exterior additives to ensure longevity, such as oils for the rolled steel, or UV protection on the synthetic polymer embodiments.

Figure 2:
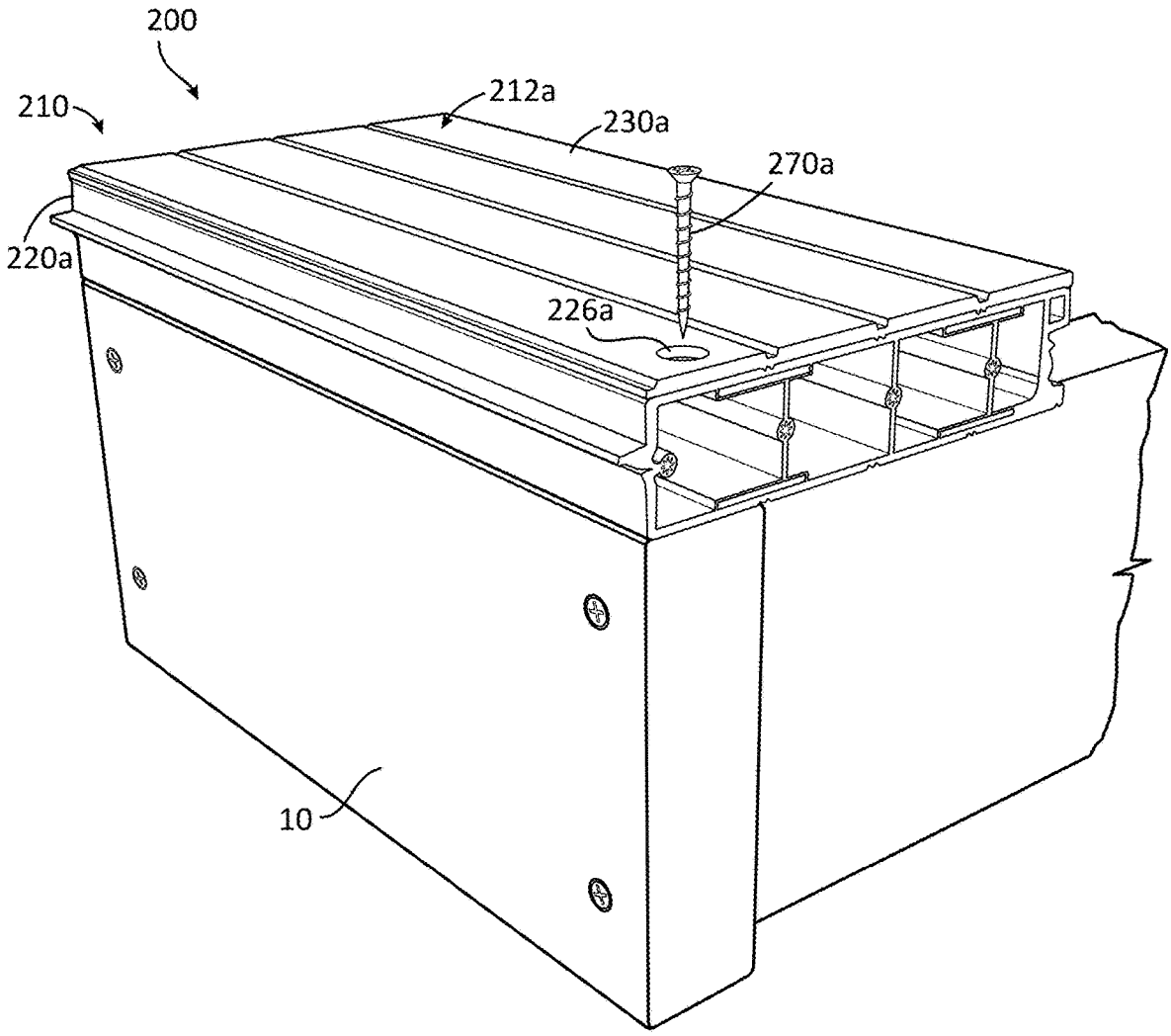
FIG. 2 is a perspective view of an illustration of an example deck board system according to the present disclosure.

Referring now to FIG. 2, is a perspective view of an illustration of an example deck board system being assembled according to the present disclosure. In particular, in FIG. 2, there is shown a deck board panel 212*a* of a plurality of modular deck board panels 210 (only partially shown) of a deck board system 200 being mechanically fastened onto a frame 10.

As illustrated in FIG. 2, the extruded panel body 220*a* of the deck board panel 212*a* already has a use surface 230*a* thereon. The use surface 230*a* is chemically bonded to the extruded panel body 220*a* of the deck board panel 212*a*. The use surface 230*a* also is processed or finished to appear to be made from conventionally installed wooden or teak deck boards or slats. Moreover, the use surface 230*a* and the underlying extruded panel body 220*a* are processed or finished to have a pre-drilled aperture 226*a* therethrough. In this way, the extruded panel body 220*a* can serve to receive and hold a mechanical fastener 270*a*.

Figure 3:
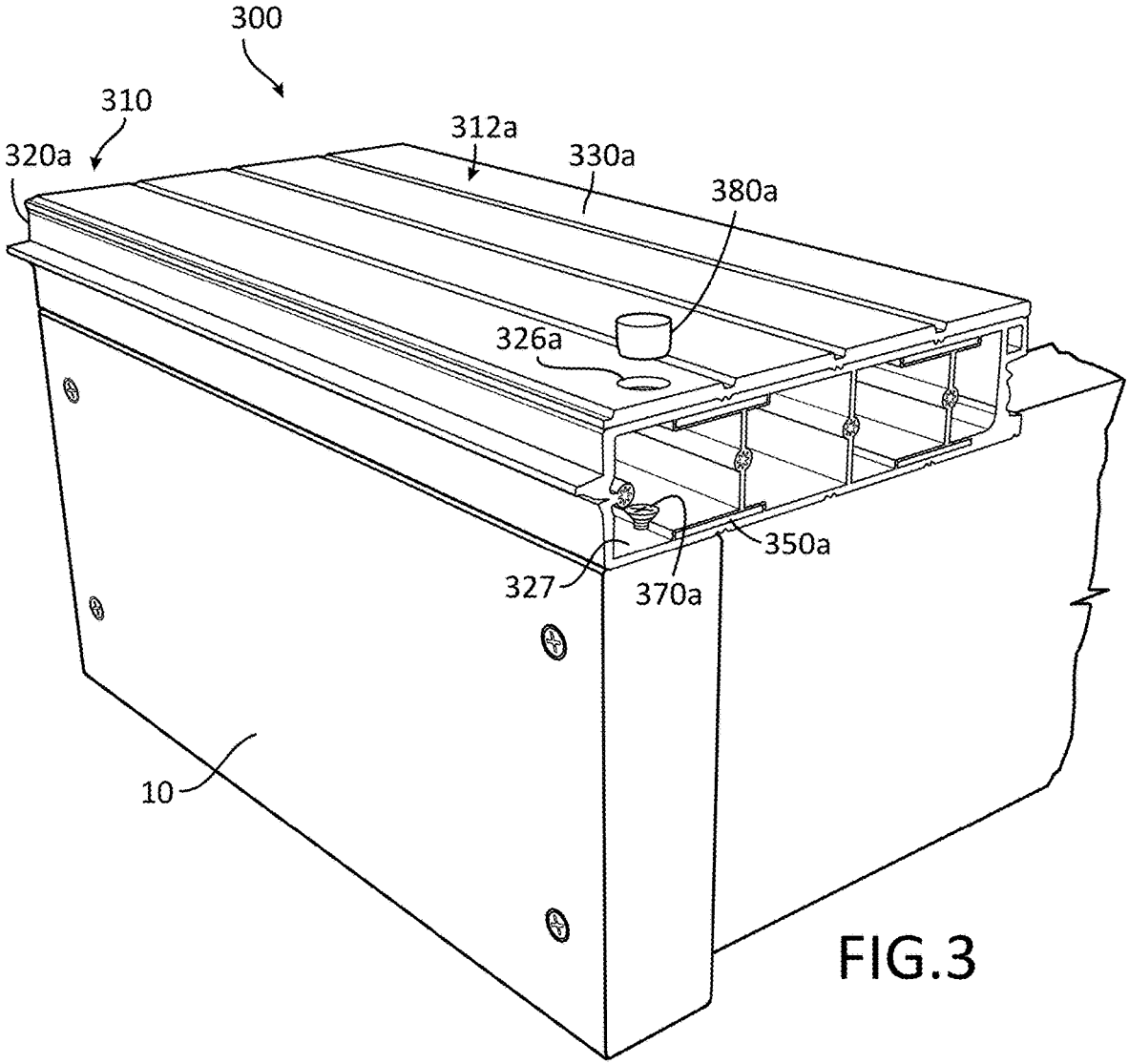
FIG. 3 is a perspective view of an illustration of an example deck board system according to the present disclosure.

Referring now to FIG. 3, is a perspective view of an illustration of an example deck board system being assembled according to the present disclosure. In particular, in FIG. 3, there is shown a deck board panel 312*a* of a plurality of modular deck board panels 310 (only partially shown) of a deck board system 300 being mechanically fastened onto a frame 10. The extruded panel body 320*a* of the deck board panel 312*a* has a use surface 330*a* chemically bonded to the extruded panel body 320*a*, and is processed/finished to appear to be made from conventionally installed wooden or teak deck boards or slats, and together both are processed/finished to have a pre-drilled aperture 326*a*. A mechanical fastener 370*a* has traversed the aperture 326*a* and is screwed through a side wall 327*a* of the extruded panel body 320*a* of the deck board panel 312*a* adjacent, and not through, an embedded internal reinforcement 350*a*, and into the underlying frame 10. In particular, as illustrated in FIG. 3, the deck board system 300 includes a plug 380*a* for the aperture 326*a* defined by the use surface 330*a*, and the plug 380*a* is configured to look like the material of the use surface 330*a* to hide the aperture 326*a*.

Figure 4:
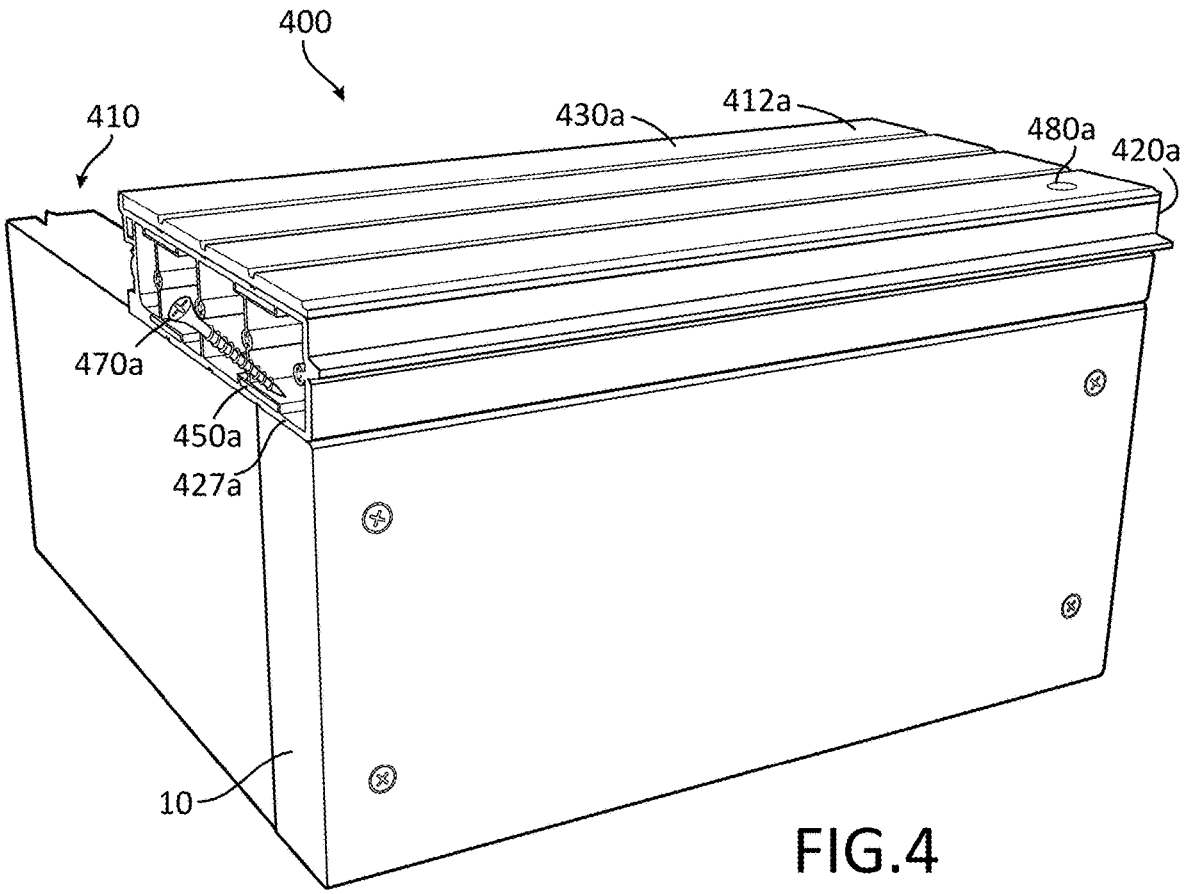
FIG. 4 is a perspective view of an illustration of an example deck board system according to the present disclosure.

Referring now to FIG. 4, is a perspective view of an illustration of an example deck board system being assembled according to the present disclosure. In particular, in FIG. 4, there is shown a deck board panel 412*a* of a plurality of modular deck board panels 410 (only partially shown) of a deck board system 400 being mechanically fastened onto a frame 10. The extruded panel body 420*a* of the deck board panel 412*a* has a use surface 430*a* chemically bonded to the extruded panel body 420*a*, and is processed/finished to appear to be made from conventionally installed wooden or teak deck boards or slats. A pre-drilled aperture 326*a* (not shown) is obscured by a plug 480*a*. As illustrated in FIG. 4, on the end of the extruded panel body 420*a* opposite the plug 480*a*, a mechanical fastener 370*a*' is positioned for screwing through a side wall 427*a* of the extruded panel body 420*a* of the deck board panel 412*a* adjacent, and not through, an embedded internal reinforcement 450*a*, and into the underlying frame 10. In particular, as illustrated in FIG. 4, the mechanical fastener 470*a*' is positioned at an angle.

Figure 5:
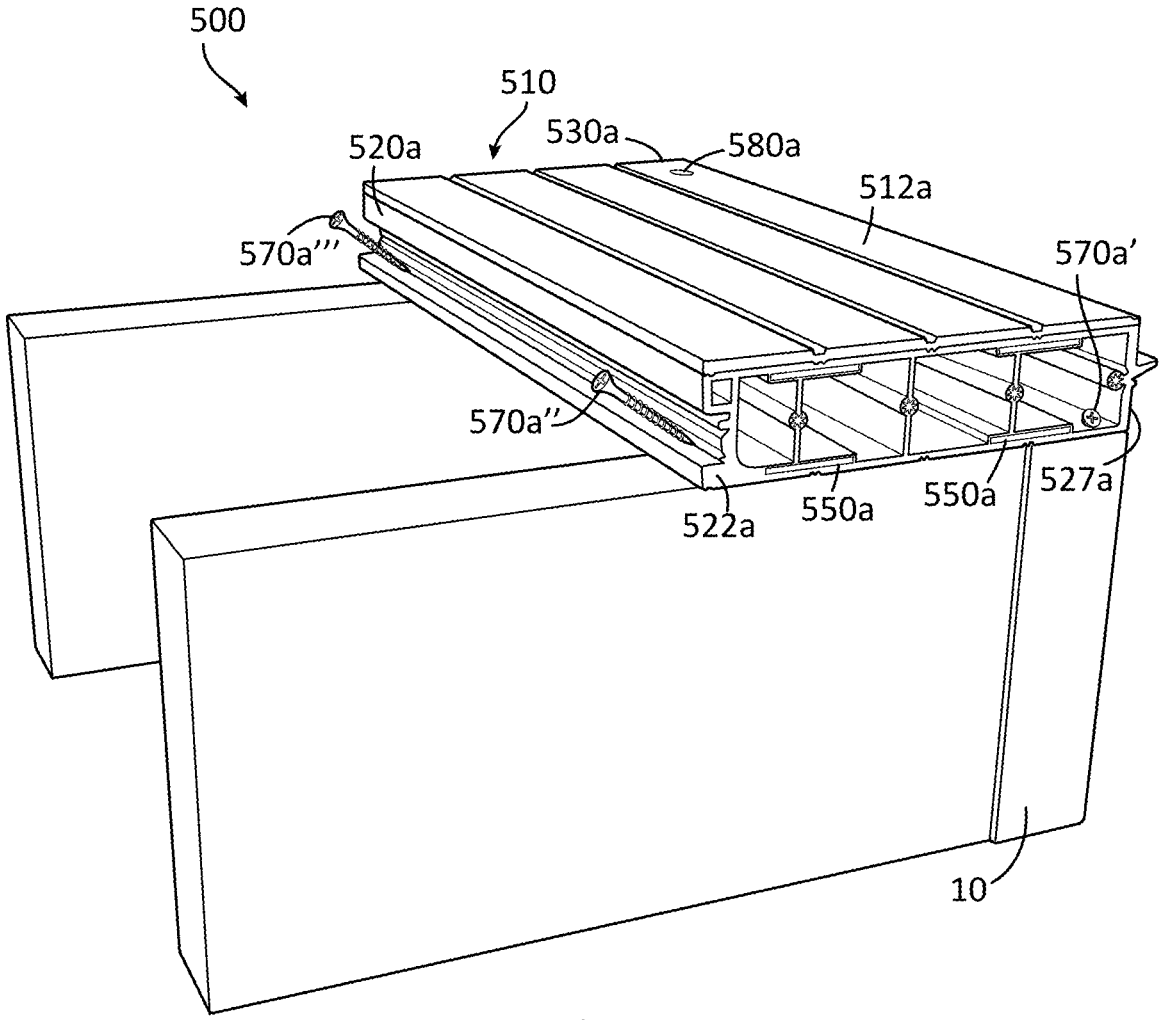
FIG. 5 is a perspective view of an illustration of an example deck board system according to the present disclosure.

Referring now to FIG. 5, is a perspective view of an illustration of an example deck board system being assembled according to the present disclosure. In particular, in FIG. 5, there is shown a deck board panel 512*a* of a plurality of modular deck board panels 510 (only partially shown) of a deck board system 500 being mechanically fastened onto a frame 10. The extruded panel body 520*a* of the deck board panel 512*a* has a use surface 530*a* chemically bonded to the extruded panel body 520*a*, and is processed/finished to appear to be made from conventionally installed wooden or teak deck boards or slats. A pre-drilled aperture 526*a* (not shown) is obscured by a plug 580*a*. As illustrated in FIG. 5, on the end of the extruded panel body 520*a* opposite the plug 580*a*, a mechanical fastener 570*a*' is screwed through a side wall 527*a* of the extruded panel body 520*a* of the deck board panel 512*a* adjacent, and not through, an embedded internal reinforcement 550*a*, and into the underlying frame 10. In particular, as illustrated in FIG. 4, the mechanical fastener 470*a*' is screwed at an angle. Moreover, as illustrated in FIG. 5, on the side of the extruded panel body 520*a* opposite the mechanical fastener 570*a*', a mechanical fastener 570*a*" is positioned at an angle for screwing through a ledge 522 of the extruded panel body 520*a* of the deck board panel 512*a* adjacent, and not through, an embedded internal reinforcement 550*a*, and into the underlying frame 10. Furthermore, as illustrated in FIG. 5, on the same end of the extruded panel body 520*a* but on the side opposite the plug 580*a*, a mechanical fastener 570*a*'" is positioned at an angle for screwing through the ledge 522*a* adjacent, and not through, the embedded internal reinforcement 550*a*, and into the underlying frame 10.

Figure 6:
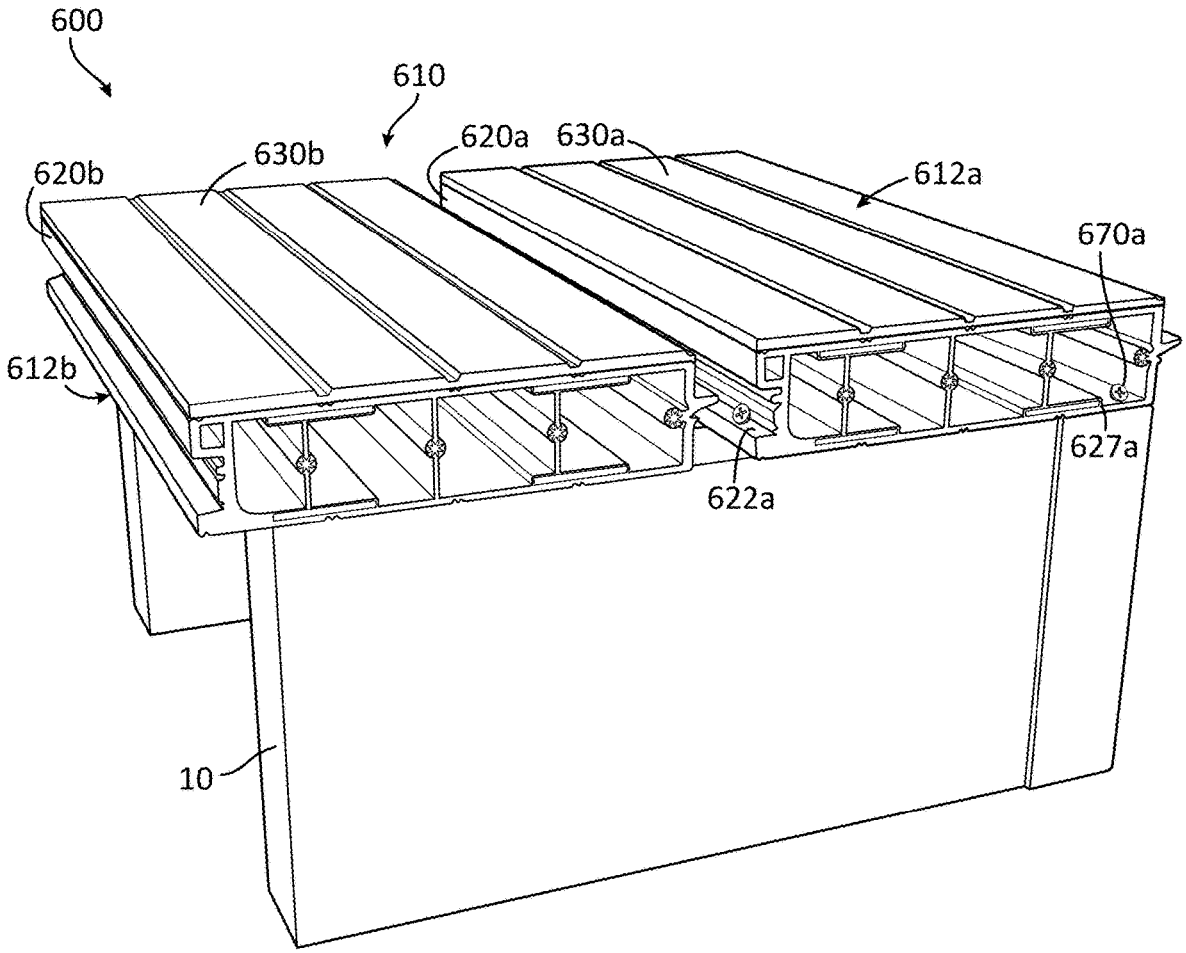
FIG. 6 is a perspective view of an illustration of an example deck board system according to the present disclosure.

Referring now to FIG. 6, is a perspective view of an illustration of an example deck board system being assembled according to the present disclosure. In particular, in FIG. 6, there is shown a deck board panel 612*a* and a deck board panel 612*b* of a plurality of modular deck board panels 610 of a deck board system 600 being mechanically fastened onto a frame 10. The extruded panel body 620*a*, 620*b* of the deck board panels 612*a*, 612*b*, respectively, each have a use surface 630 chemically bonded to the extruded panel body 620, and each is processed/finished to appear to be made from conventionally installed wooden or teak deck boards or slats. As illustrated in FIG. 6, mechanical fastener 670*a* are screwed through side walls 627*a* and/or a ledge 622*a* of the extruded panel body 620*a* of the deck board panel 612*a* and into the underlying frame 10. Moreover, as illustrated in FIG. 6, the deck board panel 612*b* is positioned on the frame adjacent to the deck board panel 612*a*.

Figure 7:
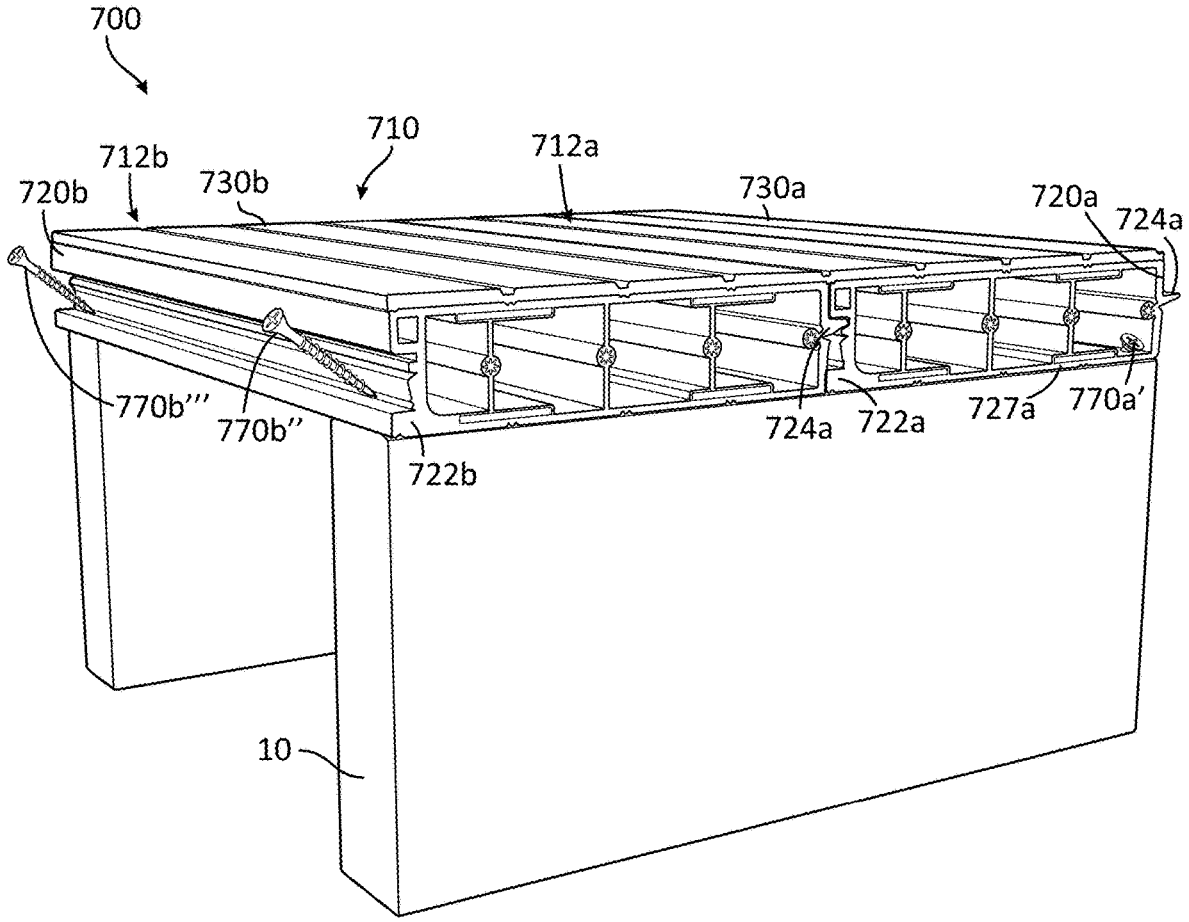
FIG. 7 is a perspective view of an illustration of an example deck board system according to the present disclosure.

Referring now to FIG. 7, is a perspective view of an illustration of an example deck board system being assembled according to the present disclosure. In particular, in FIG. 7, there is shown a deck board panel 712*a* and a deck board panel 712*b* of a plurality of modular deck board panels 710 of a deck board system 700 being mechanically fastened onto a frame 10. The extruded panel body 720*a*, 720*b* of the deck board panels 712*a*, 712*b*, respectively, each have a use surface 730 chemically bonded to the extruded panel body 720, and each is processed/finished to appear to be made from conventionally installed wooden or teak deck boards or slats. As illustrated in FIG. 7, mechanical fastener 770*a* are screwed through side walls 727*a* and/or a ledge 722*a* of the extruded panel body 720*a* of the deck board panel 712*a* and into the underlying frame 10. Moreover, as illustrated in FIG. 7, the deck board panel 712*b* is positioned and slid on the frame 10 adjacent to the deck board panel 712*a* and into contact with the adjacent deck board panel 712*a* such that an overhang 724*b* of the extruded panel body 720*b* is touching and/or interlocked with the adjacent deck board panel 712*a*.

Figure 8:
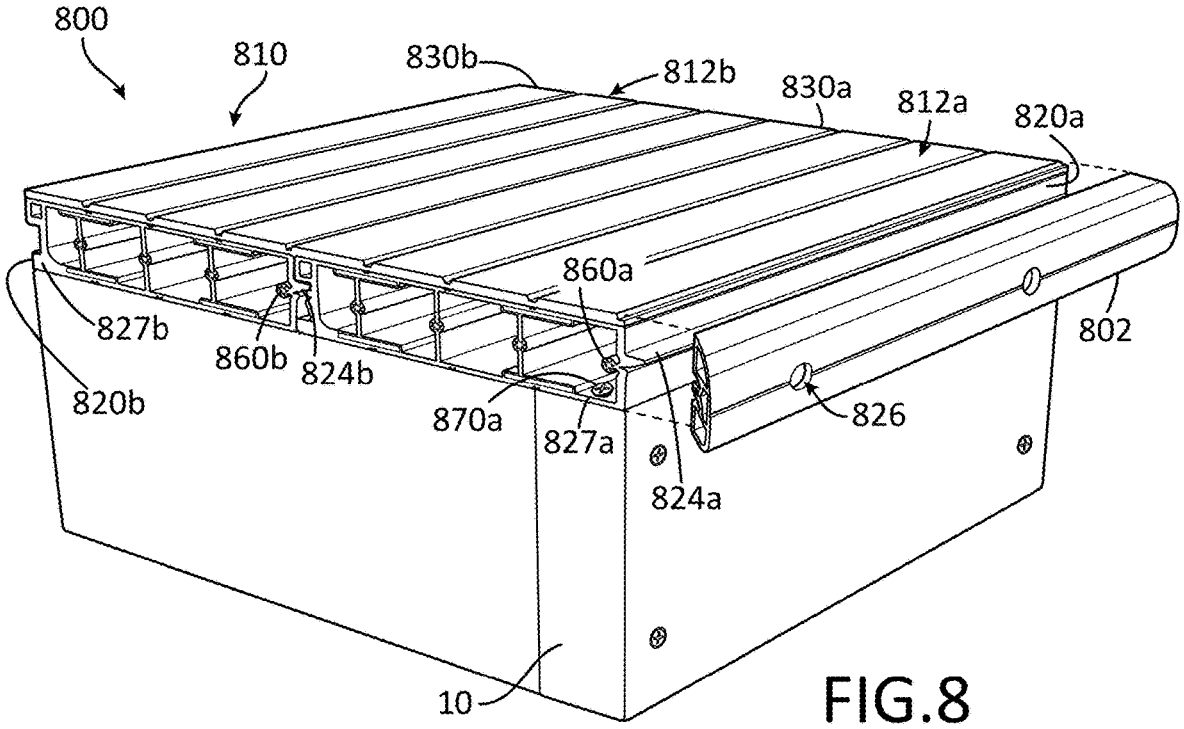
FIG. 8 is a perspective view of an illustration of an example deck board system according to the present disclosure.

Referring now to FIG. 8, is a perspective view of an illustration of an example deck board system being assembled according to the present disclosure. In particular, in FIG. 8, there is shown a deck board panel 812*a* and a deck board panel 812*b* of a plurality of modular deck board panels 810 of a deck board system 800 mechanically fastened to a frame 10. The extruded panel body 820*a*, 820*b* of the deck board panels 812*a*, 812*b*, respectively, each have a use surface 830 chemically bonded to the extruded panel body 820, and each is processed/finished to appear to be made from conventionally installed wooden or teak deck boards or slats. As illustrated in FIG. 8, mechanical fastener 870*a* are screwed through side walls 827*a* and/or a ledge 822*a* of the extruded panel body 820*a* of the deck board panel 812*a* and into the underlying frame 10. Moreover, mechanical fastener 870*b* are screwed through side walls 827*b* and/or a ledge 822*b* of the extruded panel body 820*b* of the deck board panel 812*b* and into the underlying frame 10. As illustrated in FIG. 8, an overhang 824*b* of the extruded panel body 820*b* is touching and/or interlocked with the adjacent deck board panel 812*a*.

As illustrated in FIG. 8, the deck board panel 812*a* and the deck board panel 812*b* of the plurality of modular deck board panels 810 include a plurality of screw bosses 860 configured to receive mechanical fasteners 870*a*. For example, in FIG. 8, a first rounded edge panel 802 (also known as a bull nose configuration) of the deck board system 800 is positioned for being mechanically fastened to the extruded panel body 820*a* of the deck board panel 812*a* along an overhang 824*a*. Moreover, the first rounded edge panel 802 is processed/finished to have pre-drilled apertures 826 therethrough. In this way, the first rounded edge panel 802 can serve to receive and hold mechanical fasteners 870*a* (best seen in FIG. 9 as 970*a*). Additionally, the first rounded edge panel 802, or any of the other edge panels may have an indication line on one side and may not have such a line on the opposite side. Therefore, allowing for reversal of the first rounded edge panel 802 to conform to the teak line of the finishing feature. In this aspect, the installer may easily align the teak markings or indications in the surface by reversing the edge panels to conform to desired aesthetics. In further aspects, the first rounded edge panel serves as a bumper, as it is comprised mainly of flexible PVC, it may be a bolster or bumper for incoming watercraft, or other objects. The structural design of the first rounded edge panel 802 allows for impact and cushioning, by having several air gaps and compression points. These air gaps and compression points serve to resiliently bolster against repeated impact, while allowing the edge panel to maintain integrity.

Figure 9:
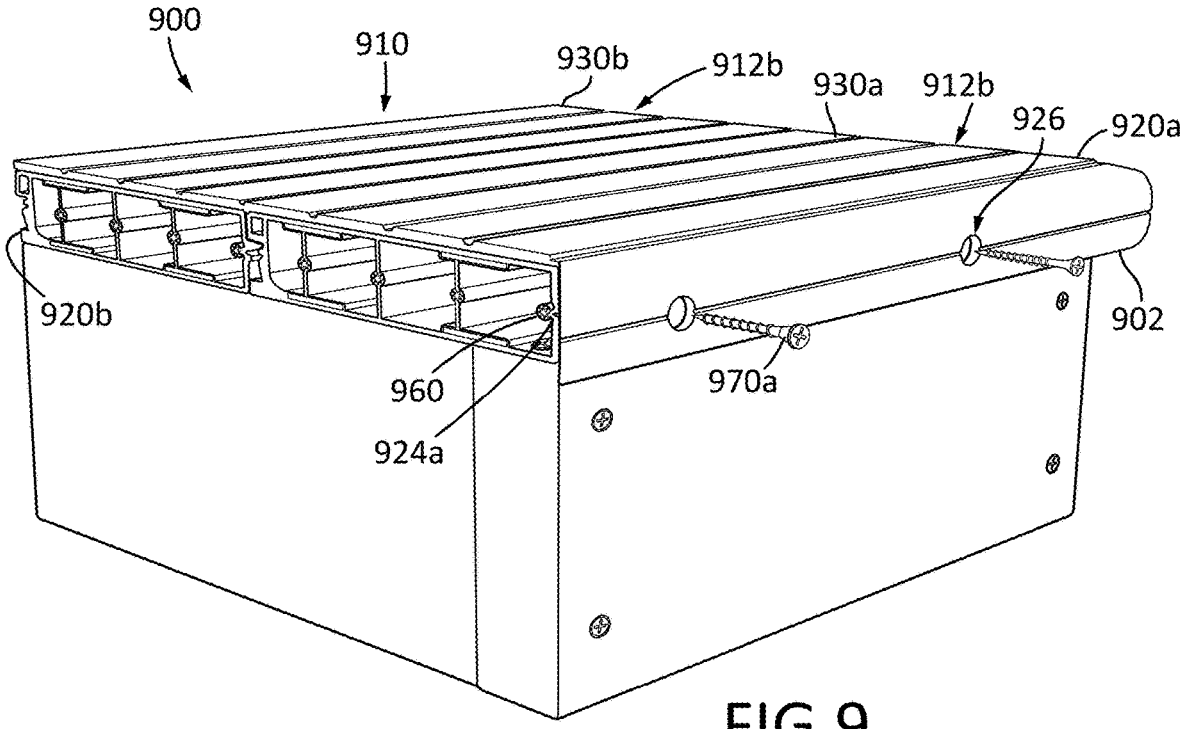
FIG. 9 is a perspective view of an illustration of an example deck board system according to the present disclosure.

Referring now to FIG. 9, is a perspective view of an illustration of an example deck board system 900 being assembled according to the present disclosure. In particular, in FIG. 9, there is shown a deck board panel 912*a* and a deck board panel 912*b* of a plurality of modular deck board panels 910 of a deck board system 900 mechanically fastened to a frame. The extruded panel body 920*a*, 920*b* of the deck board panels 912*a*, 912*b*, respectively, each have a use surface 930*a*, 930*b* chemically bonded and/or mechanically bonded to the extruded panel body 920, and each is processed/finished to appear to be made from conventionally installed wooden or teak deck boards or slats. As illustrated in FIG. 9, a first rounded edge panel 902 of the deck board system 900 is positioned for being mechanically fastened to the extruded panel body 920*a* of the deck board panel 912*a* along an overhang 924*a*. Moreover, the first rounded edge panel 902 is processed/finished to have pre-drilled apertures 926 therethrough and mechanical fasteners 970*a* are positioned for being screwed into the screw boss 960. Furthermore, as illustrated in FIG. 9, the first rounded edge panel 902 also is processed/finished to appear to be made from conventionally installed wooden or teak deck boards or slats and to match the use surface 930*a*.

Figure 10:
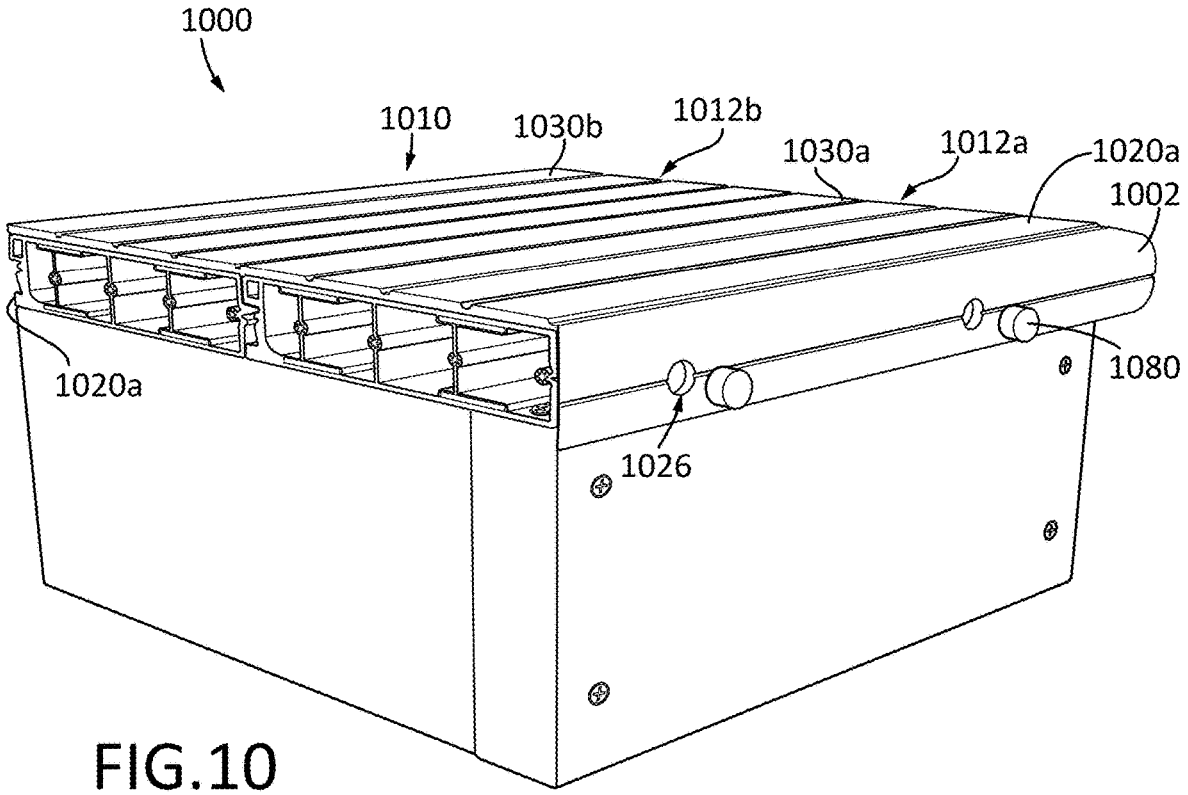
FIG. 10 is a perspective view of an illustration of an example deck board system according to the present disclosure.

Referring now to FIG. 10, is a perspective view of an illustration of an example deck board system being assembled according to the present disclosure. In particular, in FIG. 10, there is shown a deck board panel 1012*a* and a deck board panel 1012*b* of a plurality of modular deck board panels 1010 of a deck board system 1000 mechanically fastened to a frame 10. The extruded panel body 1020*a*, 1020*b* of the deck board panels 1012*a*, 1012*b*, respectively, each have a use surface 1030 chemically bonded to the extruded panel body 1020, and each is processed/finished to appear to be made from conventionally installed wooden or teak deck boards or slats. As illustrated in FIG. 10, a first rounded edge panel 1002 of the deck board system 1000 is positioned and mechanically fastened, via the mechanical fasteners 1070 (not shown) to the extruded panel body 1020*a* of the deck board panel 1012*a*. Moreover, the first rounded edge panel 1002 is processed/finished to have pre-drilled apertures 1026 therethrough. Furthermore, as illustrated in FIG. 10, the deck board system 1000 also includes plugs 1080 for the apertures 1026 defined by the first rounded edge panel 1002, and plugs 1080 are configured to hide the apertures 1026.

Figure 11:
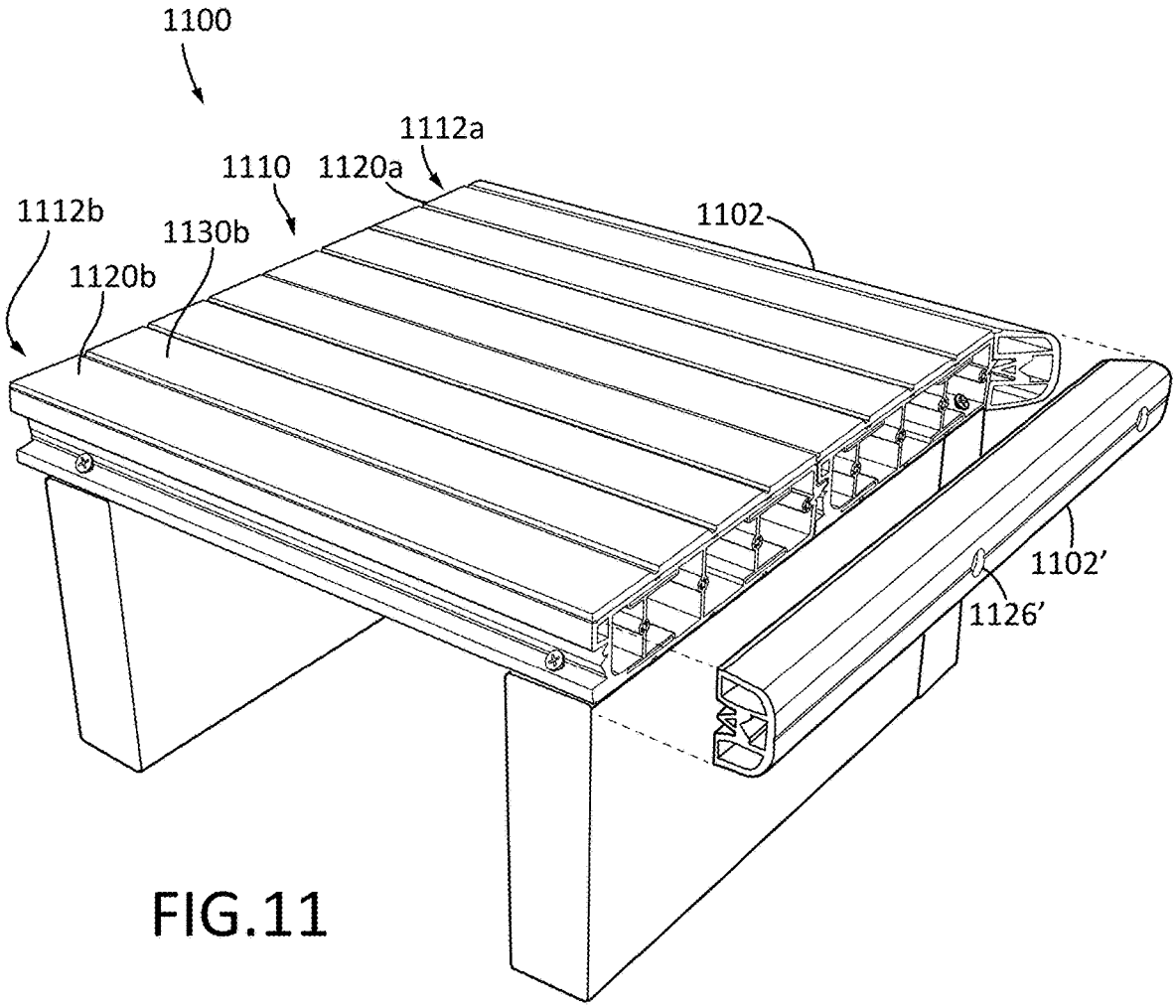
FIG. 11 is a perspective view of an illustration of an example deck board system according to the present disclosure.

Referring now to FIG. 11, is a perspective view of an illustration of an example deck board system being assembled according to the present disclosure. In particular, in FIG. 11, there is shown a deck board panel 1112*a* and a deck board panel 1112*b* of a plurality of modular deck board panels 1110 of a deck board system 1100 mechanically fastened to a frame 10. The extruded panel body 1120*a*, 1120*b* of the deck board panels 1112*a*, 1112*b*, respectively, each have a use surface 1130 chemically bonded to the extruded panel body 1120, and each is processed/finished to appear to be made from conventionally installed wooden or teak deck boards or slats.

As illustrated in FIG. 11, a first rounded edge panel 1102 of the deck board system 1100 is positioned and mechanically fastened, via the mechanical fasteners 1170 (not shown) to the extruded panel body 1120*a* of the deck board panel 1112*a*. Furthermore, as illustrated in FIG. 11, a second rounded edge panel 1102' of the deck board system 1100 is positioned for being mechanically fastened to the extruded panel body 1120*a*, 1120*b* of the deck board panels 1112*a*, 1112*b*, respectively. Moreover, the second rounded edge panel 1102' is processed/finished to have pre-drilled apertures 1126' therethrough. In this way, the second rounded edge panel 1102' can serve to receive and hold mechanical fasteners 1170' (best seen in FIG. 12).

Figure 12:
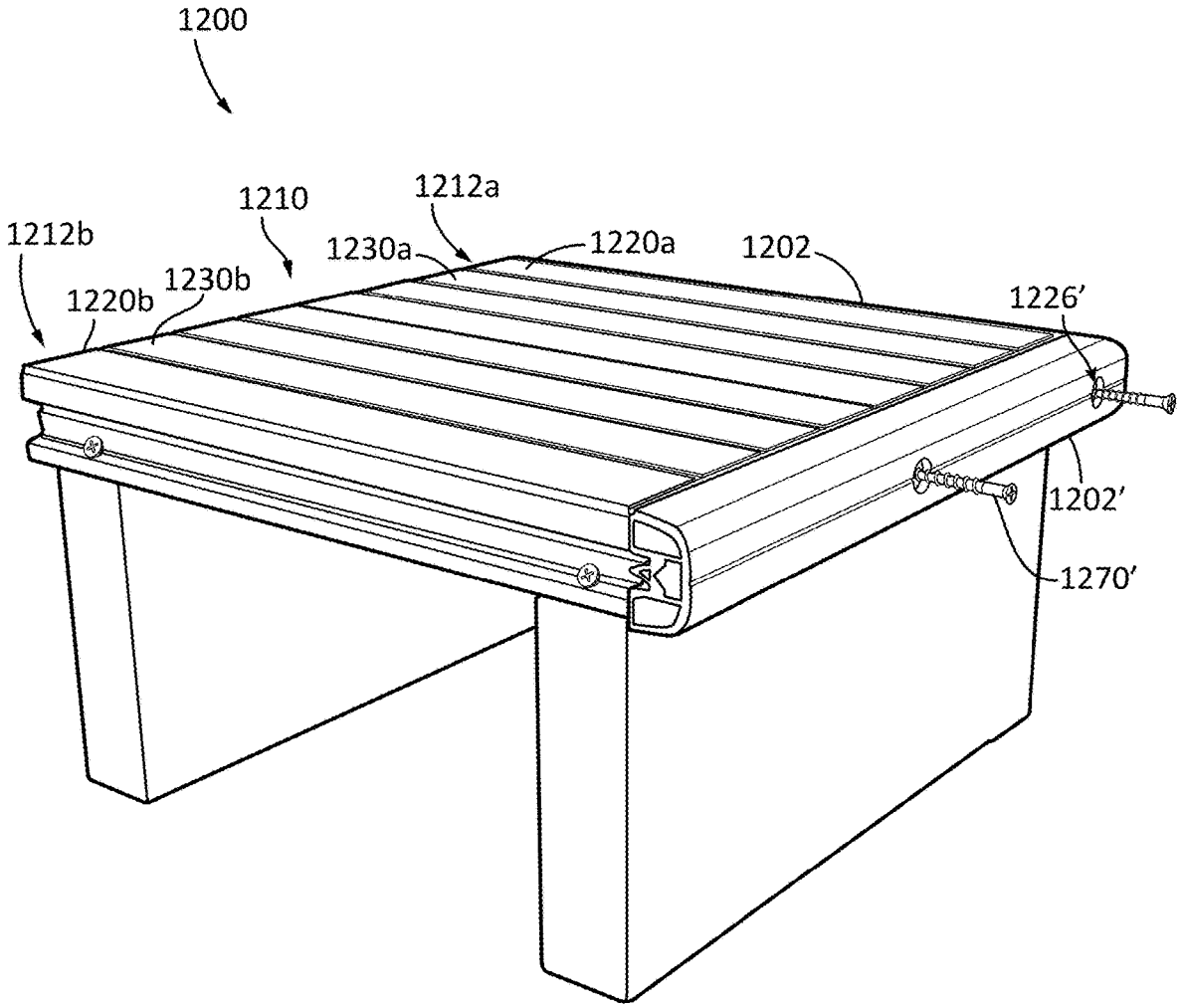
FIG. 12 is a perspective view of an illustration of an example deck board system according to the present disclosure.

Referring now to FIG. 12, is a perspective view of an illustration of an example deck board system being assembled according to the present disclosure. In particular, in FIG. 12, there is shown a deck board panel 1212*a* and a deck board panel 1212*b* of a plurality of modular deck board panels 1210 of a deck board system 1200 mechanically fastened to a frame. The extruded panel body 1220*a*, 1220*b* of the deck board panels 1212*a*, 1212*b*, respectively, each have a use surface 1230 chemically bonded to the extruded panel body 1220, and each is processed/finished to appear to be made from conventionally installed wooden or teak deck boards or slats.

As illustrated in FIG. 12, a first rounded edge panel 1202 of the deck board system 1200 is positioned and mechanically fastened, via the mechanical fasteners 1270 (not shown) to the extruded panel body 1220*a* of the deck board panel 1212*a*. Furthermore, as illustrated in FIG. 12, a second rounded edge panel 1202' of the deck board system 1200 is positioned for being mechanically fastened to the extruded panel body 1220*a*, 1220*b* of the deck board panels 1112*a*, 1112*b*, respectively (i.e., the second rounded edge panel 1202' straddles both the deck board panels 1112*a*, 1112*b*). Moreover, the second rounded edge panel 1202' is processed/finished to have pre-drilled apertures 1226' therethrough and through which mechanical fasteners 1270' can be received. In this way, the second rounded edge panel 1202' meets with and creates a contiguous, continuous edge surface with the first rounded edge panel 1202 and meets with the use surface 1230.

Figure 13:
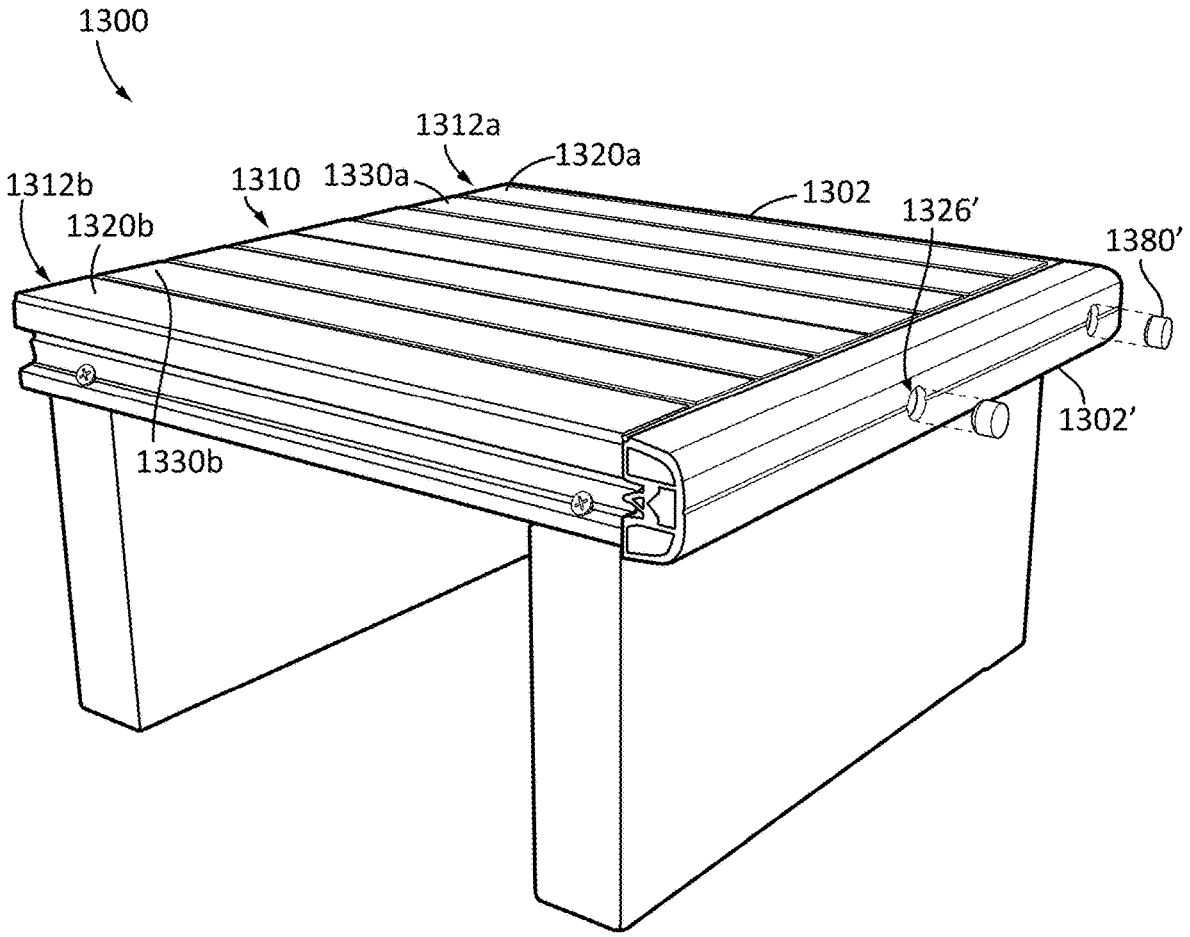
FIG. 13 is a perspective view of an illustration of an example deck board system according to the present disclosure.

Referring now to FIG. 13, is a perspective view of an illustration of an example deck board system being assembled according to the present disclosure. In particular, in FIG. 13, there is shown a deck board panel 1312*a* and a deck board panel 1312*b* of a plurality of modular deck board panels 1310 of a deck board system 1300 mechanically fastened to a frame 10. The extruded panel body 1320*a*, 1320*b* of the deck board panels 1312*a*, 1312*b*, respectively, each have a use surface 1330 chemically bonded to the extruded panel body 1320, and each is processed/finished to appear to be made from conventionally installed wooden or teak deck boards or slats. A second rounded edge panel 1302' is processed/finished to have pre-drilled apertures 1326' therethrough and through which mechanical fasteners 1370' can be received. Moreover, as illustrated in FIG. 13, the deck board system 1300 also includes plugs 1380' for the apertures 1326' defined by the second rounded edge panel 1302', and plugs 1380 are configured to hide the apertures 1326'.

Figure 14:
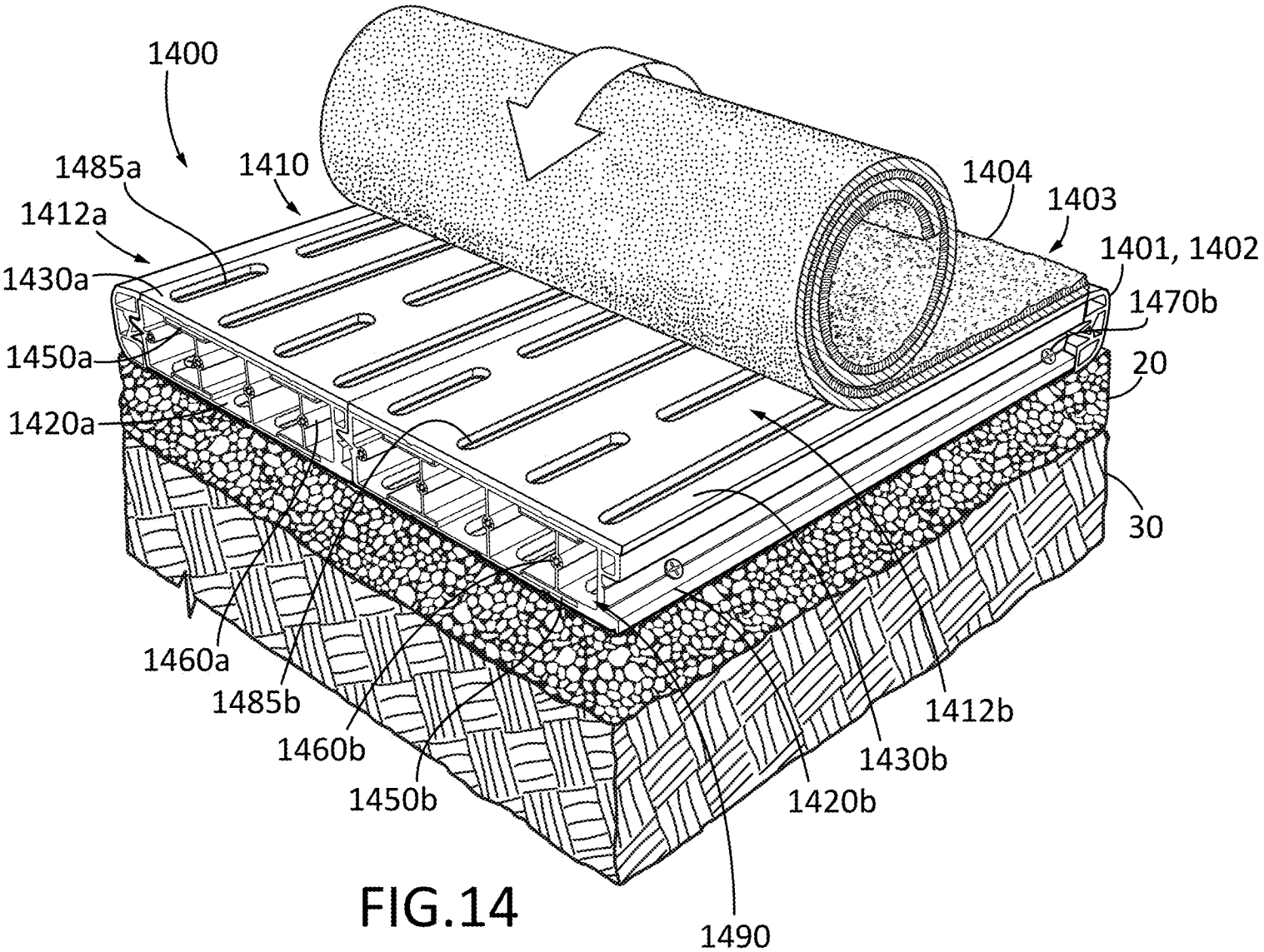
FIG. 14 is a perspective view of an illustration of an example deck board system having an artificial turf layer and a drainage feature according to the present disclosure.

Referring now to FIG. 14, a perspective view of an illustration of an example deck board system having an artificial turf layer and a drainage feature according to the present disclosure is shown. In particular, in FIG. 14 there is shown a multi-component, modular type deck board system 1400 including a plurality of finishing features 1401, in particular, a plurality of rounded edge panels 1402, an artificial turf layer (or system) 1404, and a plurality of modular deck board panels 1410. The deck board system 1400 is assembled and installed on a leveling base layer 20 over a substrate 30 to create a contiguous, seemingly-flush, generally planar support surface 1403 (see FIG. 16).

As illustrated in FIG. 14, each of the plurality of modular deck board panels 1410 of the deck board system 1400, in particular, the deck board panel 1412*a* and the deck board panel 1412*b*, has an extruded panel body 1420*a*, 1420*b*, respectively, and a use surface 1430*a*, 1430*b* respectively. More specifically, as illustrated in FIG. 1, the plurality of modular deck board panels 110 are manufactured to include one or more internal reinforcements 1450, and one or more screw bosses 1460 configured to receive mechanical fasteners 1470 for installing the deck board system 1400 and configured to receive the mechanical fasteners 1470 for installing other components of the deck board system 1400 to the deck board panels 1412*a*, 1412*b*. The one or more internal reinforcements 1450*a*, 1450*b* provide structural integrity to the panel body 1420*a*, 1420*b* such that each deck board panel 1412*a*, 1412*b*, respectively, can withstand downward loads (i.e., loads towards the frame) placed thereon. The one or more internal reinforcements 1450 may be comprised of several layers for increasing rigidity.

As illustrated in FIG. 14, the deck board panels 1412 are processed (e.g., cut, sheared, sawed, etched, chamfered, bent, pre-drilled, bored, built-up, chemically prepared, machined, etc.) during manufacturing or on-site during system. In particular, in some aspects, the deck board panels 1412 are pre-drilled or pre-bored to allow for ready placement and use of the mechanical fasteners 1470. Moreover, in some aspects, the deck board panels are CNC machined to include drainage openings 1485 as a drainage feature. In some aspects, the drainage openings 1485 have varied sizes and/or shapes. In some aspects, the drainage openings 1485 have periodic or repeating patterns. In some aspects, the drainage openings 1485 have uniform, or consistent, or standard patterns or spacing.

Returning to FIG. 14, the extruded panel body 1420 of each of the plurality of modular deck board panels 1410 according to the present disclosure serves to receive and hold the use surface 1430. In particular, as illustrated in FIG. 14, the use surface 1430 is chemically bonded to the panel body 120 of each of the plurality of modular deck board panel 1410, and the use surface 1430 so too has been CNC machined to include corresponding drainage openings 1485. Moreover, the use surface 1430 (and the extruded panel body 1420) may be made further processed or finished (e.g., scuffed, cut, sheared, sawed, etched, chamfered, notched, bent, drilled, bored, built-up, sanded, worn, chemically prepared, machined, etc.) to appear, aesthetically, as if made from a plurality of single-piece lineal boards or lineal slats, or to provide for other drainage features (e.g., drainage channels or slip resistant surface features, etc.). Moreover, in another aspect, an underside 1490 of the extruded panel body 1420 also may be CNC machined to include drainage features and/or storm surge damage prevention features (best seen in FIG. 15).

Furthermore, in another aspect, the artificial turf layer 1404 serves to cover a plurality of extruded panel bodies 1420 to form the finished support surface 1403 of the deck board system 1400. As illustrated in FIG. 14, the artificial turf layer 1404 is a two-layer system having a base layer woven with artificial turf filaments or strands that extend out of the base layer. In another aspect, the artificial turf layer 1404 is configured and may be a more complex system having a plurality of layers (adhesive layer, nap layer, woven layer, etc). In any case, the artificial turf layer 1404 is configured to be permeable such that the drainage openings 1485 function to channel liquids from the artificial turf layer 1404 to or through different regions or portions of the extruded panel body 1420. Additionally, the drainage openings 1485 function to channel liquids from the artificial turf layer 1404 to the leveling base layer 20 and, ultimately, the substrate 30. Thus allowing outdoor stadiums the ability to rapidly drain, to allow continued usage even under heavy storms. In some aspects the artificial turf layer 1404 is secured via an adhesive to the top of the deck panel, in other aspects the artificial turf layer 1404 may be heat bonded or melted to the top of the deck panel.

Figure 15:
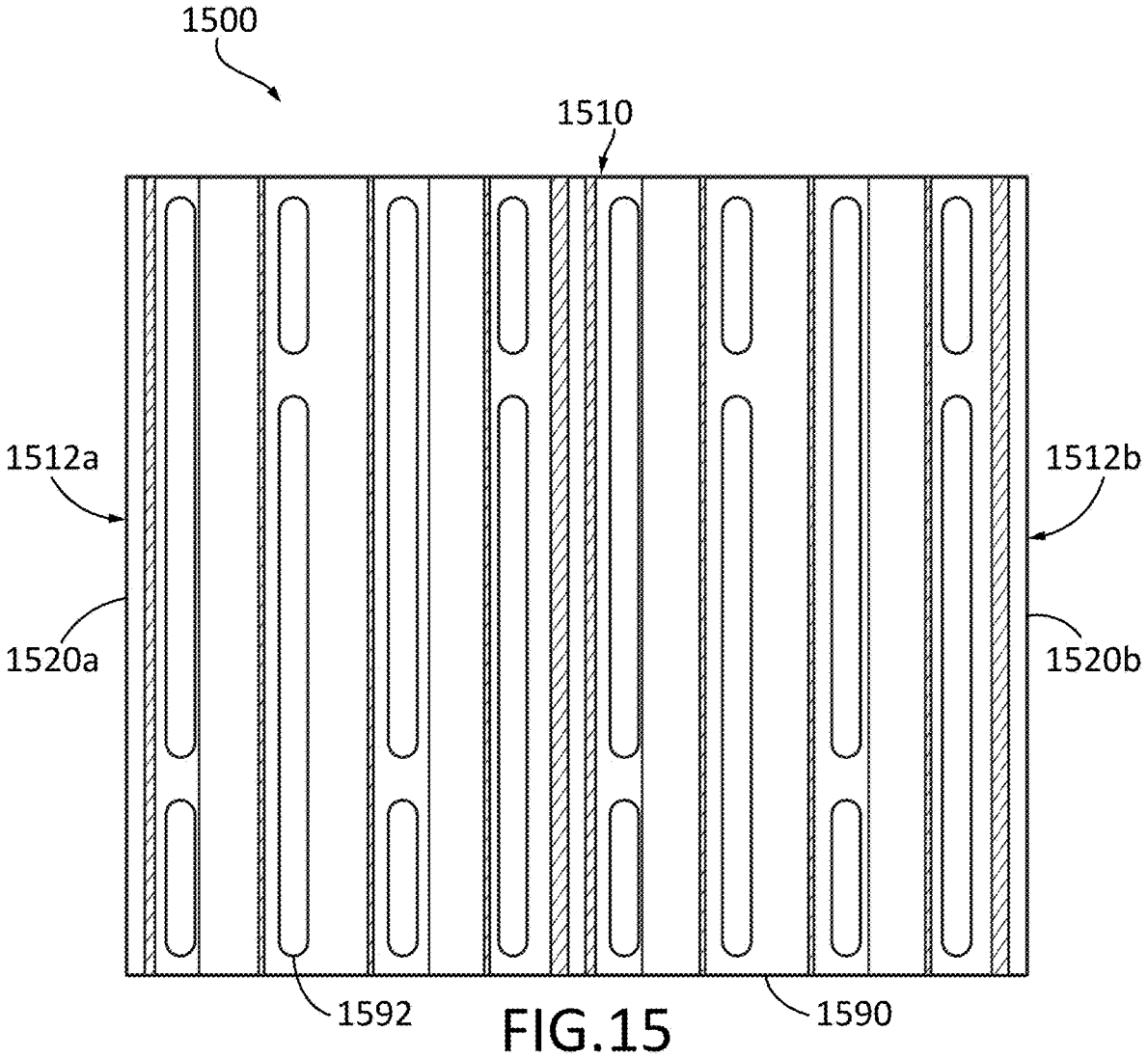
FIG. 15 is a sectional, top view, taken along the line 15-15 of FIG. 14, of an example deck board system according to the present disclosure.

Referring now to FIG. 15, a sectional, top view, taken along the line 15-15 of FIG. 14, of an example deck board system according to the present disclosure is shown. In particular, in FIG. 15, there is shown a top view in the direction of the arrows 15-15 of FIG. 14. Moreover, in FIG. 15 there is shown a multi-component, modular type deck board system 1500 including a plurality of modular deck board panels 1510.

As illustrated in FIG. 15, each of the plurality of modular deck board panels 1510 of the deck board system 1500, in particular, the deck board panel 1512*a* and the deck board panel 1512*b*, has an extruded panel body 1520*a*, 1520*b*, respectively. The underside 1590 of each extruded panel body 1520 is CNC machined to include underside openings 1592 as a drainage features. In particular, the underside openings 1592 are configured to channel liquids from within the extruded panel body 1420 to or through different regions or portions of the extruded panel body 1420. In particular, the underside openings 1592 function to channel liquids from within the extruded panel body 1422 to the leveling base layer 20 and, ultimately, the substrate 30. In some aspects, the underside openings 1592 have varied sizes and/or shapes. In some aspects, the underside openings 1592 have periodic or repeating patterns. In some aspects, the underside openings 1592 have uniform, or consistent, or standard patterns or spacing. In some aspect, the underside openings 1592 correspond to the drainage openings 1585 (not shown; best seen in FIG. 14), and yet in other aspects the underside openings 1592 have an opposite or inverted pattern as compared to the drainage openings 1585.

Figure 16:
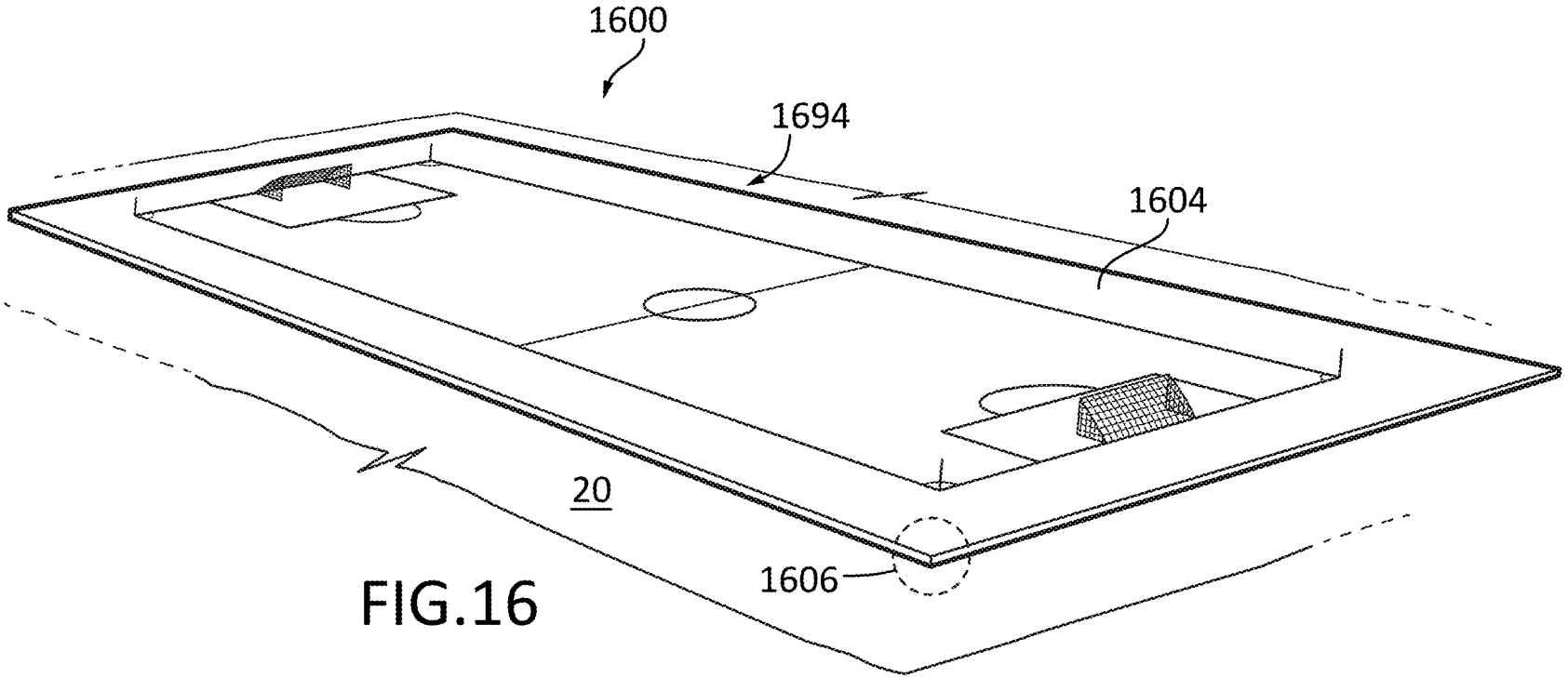
FIG. 16 a perspective view of an illustration of an example field comprising a deck board system according to the present disclosure.

Referring now to FIG. 16, a perspective view of an illustration of an example field comprising a deck board system according to the present disclosure is shown. In particular, in FIG. 16, there is shown a field 1694 comprising a multi-component, modular type deck board system 1600 including an artificial turf layer 1604. Moreover, in FIG. 16, there is shown a magnification and cut-out 1606 revealing one corner of the deck board system and to referring to FIG. 17A or 17B.

Figure 17A:
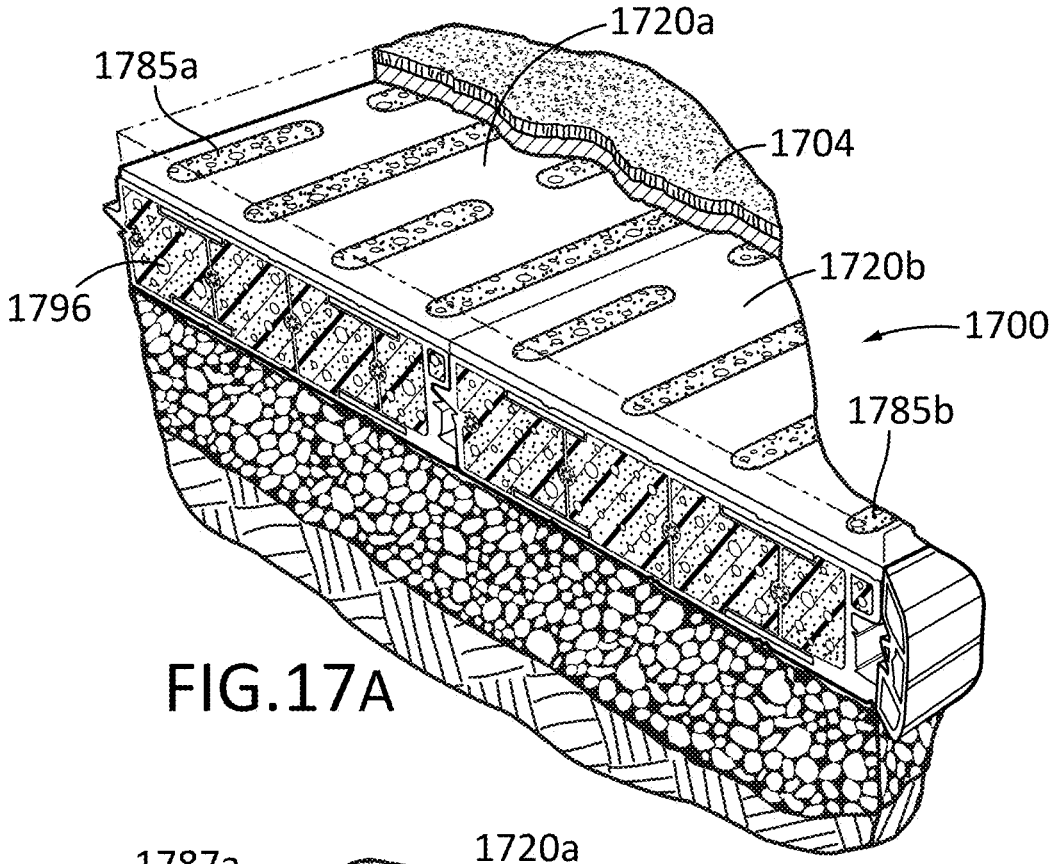
FIG. 17A is a sectional, side perspective view of a first example deck board system according to the present disclosure, taken at the magnification and cut-out of FIG. 14.
Figure 17B:
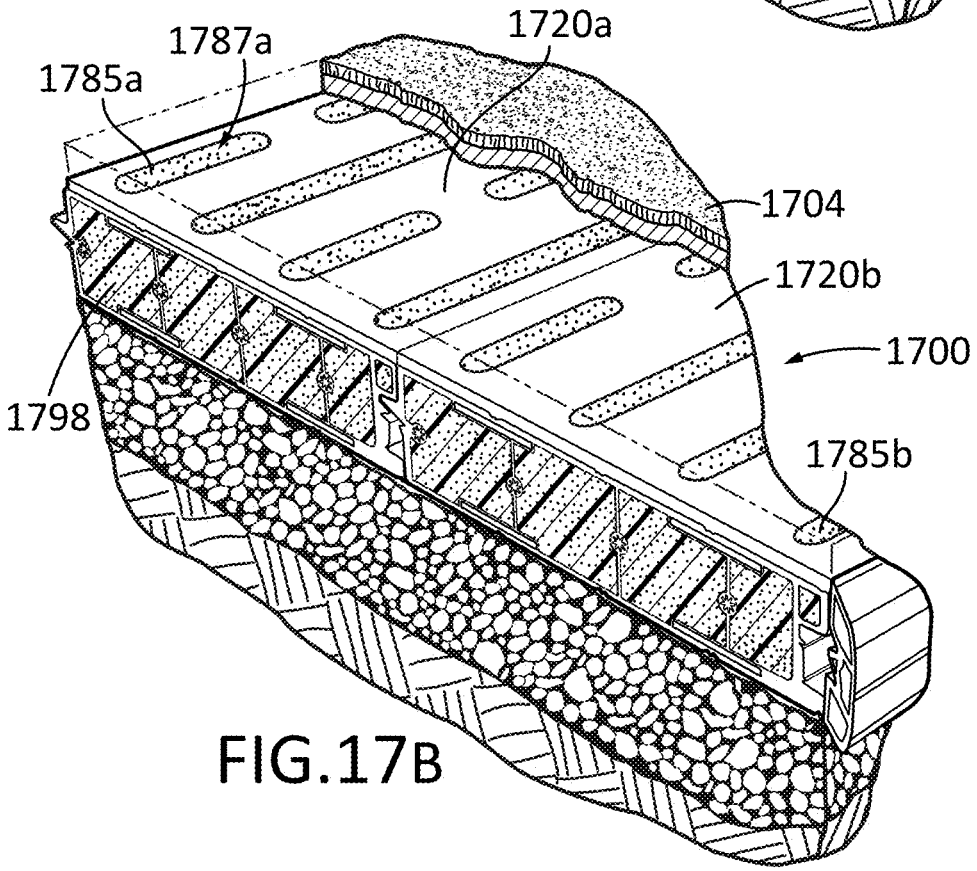
FIG. 17B is a sectional, side perspective view of a second example deck board system according to the present disclosure, taken at the magnification and cut-out of FIG. 14.

Referring now to FIG. 17A, a sectional, side perspective view of a first example deck board system according to the present disclosure, taken at the magnification and cut-out of FIG. 14, is shown. In FIG. 17B, a sectional, side perspective view of a second example deck board system according to the present disclosure, taken at the magnification and cut-out of FIG. 14, is shown. In FIGS. 17A and 17B, there is shown a side perspective view of an open cell foam embodiment (FIG. 17A) and a side perspective view of a closed cell foam embodiment (FIG. 17B), in the direction of the arrows 17-17 of FIG. 14, via the magnification and cut-out 1606. A top surface 1720*a*, 1720*b* is disclosed upon which the drainage channels are formed in, and upon which the artificial turf layer 1704 is chemically or mechanically bonded. In some aspects, the open cell foam 1796 of FIG. 17A is permeable, which allows for liquid to drain through the foam itself (from the artificial turf grass layer 1704), and which avoids the need for drainage channels or passageways in the foam layer. In some aspects, the closed cell foam 1798 of FIG. 17B is not readily permeable, which necessitates that the foam layer defines drainage channels 1787*a* or passageways to allow for liquid to drain from the artificial turf grass layer 1704 past the foam layer 1798. In some aspects, the topside drainage openings 1785*a*, 1785*b* and/or the underside drainage openings (not shown) correspond and form the drainage channels 1787*a*. In some aspects, the open cell foam 1796 or the closed cell foam 1798 fills in the otherwise hollow interior of the extruded panel body 1720 of the deck board system 1700 and, therefore, reduces or mitigate vibrations and/or resonance throughout the structure due to the properties of the foam dampening sound and vibrations, as well as impact resistance.

The invention claimed is:

1. A deck board system with artificial turf and drainage features, comprising:

(i) a first deck board panel and a second deck board panel, the first and second deck board panel each comprising an extruded or pultruded panel body comprising an internal screw boss and an internal reinforcement strip, the first and second deck panel each having a side comprising an overhang, an opposite side comprising a ledge, wherein the overhang is configured to engage with an ledge of an adjacent deck board panel;

(ii) a topside and an underside drainage openings on the first and second deck board panels;

(ii) a finishing feature applied to a side of at least the first or second deck board panel; and (iii) an artificial turf layer, wherein the artificial turf layer is configured to cover the first and second deck boards panels of the deck board.

2. The deck board system of claim 1, wherein the first and second deck board panels are modular.

3. The deck board system of claim 1, wherein the extruded or pultruded panel body further comprises two or more of the internal reinforcement strips.

4. The deck board system of claim 1, wherein the extruded or pultruded panel body further comprises a chemically bonded use surface, and wherein the chemically bonded use surface secures the artificial turf layer.

5. The deck board system of claim 1, wherein the finishing feature is a rounded edge panel.

6. The deck board system of claim 5, wherein the rounded edge panel is configured to meet with the chemically bonded use surface of the first deck board panel and the second deck board panel.

7. The deck board system of claim 1, wherein the deck board system further comprises a plug for an aperture through the finishing feature.

8. The deck board system of claim 1, wherein the extruded or pultruded panel body comprises a closed cell foam filling, and wherein the closed cell foam filling defines corresponding drainage channels.

9. The deck board system of claim 1, wherein the extruded or pultruded panel body comprises an open cell foam filling.

10. A method of producing a deck board with artificial turf and drainage features, comprising:

(iii) providing a first deck board panel and a second deck board panel, the first and second deck board panel each comprising an extruded or pultruded panel body comprising an internal screw boss and an internal reinforcement strip, the first and second deck panel each having a side comprising an overhang, an opposite side comprising a ledge, wherein the overhang is configured to engage with an ledge of an adjacent deck board panel;

(iv) preparing a topside and an underside with drainage openings on the first and second deck board panels;

(ii) applying a finishing feature, wherein the finishing feature is applied to a side of at least the first or second deck board panel; and (iii) applying an artificial turf layer, wherein the artificial turf layer is applied to cover the first and second deck boards panels of the deck board.

11. The deck board method of claim 10, wherein the first and second deck board panels are modular.

12. The deck board method of claim 10, wherein the extruded or pultruded panel body further comprises two or more of the internal reinforcement strips.

13. The deck board method of claim 10, wherein the extruded or pultruded panel body further comprises a chemically bonded use surface, and wherein the chemically bonded use surface secures the artificial turf layer.

14. The deck board method of claim 10, wherein the finishing feature is a rounded edge panel.

15. The deck board method of claim 14, wherein the rounded edge panel is configured to meet with the chemically bonded use surface of the first deck board panel and the second deck board panel.

16. The deck board method of claim 1, wherein the deck board system further comprises a plug for an aperture through the finishing feature.

17. The deck board method of claim 1, wherein the extruded or pultruded panel body comprises a closed cell foam filling, and wherein the closed cell foam filling defines corresponding drainage channels.

18. The deck board method of claim 1, wherein the extruded or pultruded panel body comprises an open cell foam filling.

* * * * *